US012648618B2

(12) United States Patent
Elder et al.

(10) Patent No.: US 12,648,618 B2
(45) Date of Patent: Jun. 9, 2026

(54) FOOTWEAR WITH FIBER-REINFORCED FLUID-FILLED BLADDER

(71) Applicant: NIKE, Inc., Beaverton, OR (US)

(72) Inventors: Zachary M. Elder, Portland, OR (US); Laura E. Flores Sandoval, Hillsboro, OR (US); Todd W. Miller, Portland, OR (US); Lee D. Peyton, Tigard, OR (US)

(73) Assignee: NIKE, Inc., Beaverton, OR (US)

( * ) Notice: Subject to any disclaimer, the term of this patent is extended or adjusted under 35 U.S.C. 154(b) by 20 days.

(21) Appl. No.: 18/315,367

(22) Filed: May 10, 2023

(65) Prior Publication Data

US 2023/0363494 A1 Nov. 16, 2023

Related U.S. Application Data

(60) Provisional application No. 63/488,755, filed on Mar. 6, 2023, provisional application No. 63/340,744, filed on May 11, 2022.

(51) Int. Cl.

| | |
|---|---|
| ***A43B 13/20*** | (2006.01) |
| ***A43B 13/02*** | (2022.01) |
| ***A43D 11/00*** | (2006.01) |

(52) U.S. Cl.

CPC ..... *A43B 13/20* (2013.01); *A43B 13/02* (2013.01); *A43D 11/00* (2013.01)

(58) Field of Classification Search

USPC ..... 36/29

See application file for complete search history.

(56) References Cited

U.S. PATENT DOCUMENTS

| | | | | |
|---|---|---|---|---|
| 4,936,029 A | 6/1990 | Rudy | | |
| 5,042,176 A * | 8/1991 | Rudy | F16F 1/3615 | 36/153 |
| 7,694,438 B1 * | 4/2010 | Christensen | A43B 3/246 | 36/29 |
| 11,044,964 B2 | 6/2021 | Meeker | | |
| 2005/0268487 A1 * | 12/2005 | Ellis, III | A43B 13/14 | 36/25 R |

(Continued)

FOREIGN PATENT DOCUMENTS

| | | |
|---|---|---|
| EP | 3267828 A1 | 1/2018 |
| TW | 200528042 A | 9/2005 |

(Continued)

*Primary Examiner* — Matthew R Marchewka
(74) *Attorney, Agent, or Firm* — Quinn IP Law

(57) ABSTRACT

A sole structure for an article of footwear includes a fluid filled bladder that is formed from a plurality of coextensive, stacked polymeric sheets. An anti-weld material is disposed between two of the polymeric sheets within a central region of the sheets, the anti-weld material operative to inhibit a first polymeric sheet from being able to thermally fuse with a second polymeric sheet wherever the anti-weld material is present. The first polymeric sheet and the second polymeric sheet are fused together in a peripheral region that surrounds the central region, the peripheral region forming a peripheral flange. At least one of the first polymeric sheet and second polymeric sheet includes a plurality of integrated reinforcing fibers that are operative to increase a modulus of elasticity of the sheet in a direction parallel to the reinforcing fibers.

18 Claims, 10 Drawing Sheets

(56) References Cited

U.S. PATENT DOCUMENTS

| | | | | |
|---|---|---|---|---|
| 2009/0094856 | A1* | 4/2009 | Guerra | A43B 7/148 36/35 B |
| 2012/0102783 | A1* | 5/2012 | Swigart | A43B 13/20 12/146 B |
| 2013/0283640 | A1 | 10/2013 | Elder et al. | |
| 2014/0020264 | A1 | 1/2014 | Holt | |
| 2018/0213886 | A1* | 8/2018 | Connell | A43B 13/184 |
| 2018/0338578 | A1* | 11/2018 | Elder | A43B 5/00 |
| 2019/0350311 | A1 | 11/2019 | Davison | |
| 2019/0365037 | A1 | 12/2019 | Forstrom et al. | |
| 2019/0365040 | A1 | 12/2019 | Auyang et al. | |
| 2020/0154825 | A1 | 5/2020 | Case et al. | |
| 2020/0154826 | A1* | 5/2020 | Case | A43B 13/20 |
| 2021/0353001 | A1 | 11/2021 | Elder et al. | |
| 2021/0368920 | A1 | 12/2021 | Elder et al. | |
| 2022/0202137 | A1* | 6/2022 | Kiss | A43B 13/20 |

FOREIGN PATENT DOCUMENTS

| | | | |
|---|---|---|---|
| TW | M559617 | U | 5/2018 |
| TW | 202042692 | A | 12/2020 |
| TW | 202112267 | A | 4/2021 |
| TW | 202128045 | A | 8/2021 |
| TW | 202133754 | A | 9/2021 |
| TW | 202200040 | A | 1/2022 |
| WO | 2014151186 | A2 | 9/2014 |
| WO | 2017160962 | A1 | 9/2017 |

* cited by examiner

FOOTWEAR WITH FIBER-REINFORCED FLUID-FILLED BLADDER

CROSS REFERENCE TO RELATED APPLICATION

The present application claims the benefit of priority from U.S. Provisional Patent Application No. 63/340,744, filed 11 May 2022, and from U.S. Provisional Patent Application No. 63/488,755, filed 6 Mar. 2023, both of which are incorporated by reference in their entirety and for all that they disclose.

TECHNICAL FIELD

The present disclosure generally relates to cushioning structures which include a fiber-reinforced bladder, including cushioning structures for an article of footwear, apparel, or sporting equipment.

BACKGROUND

Cushioning structures are commonly used to provide cushioning in a variety of consumer goods, including in articles of footwear, apparel and sporting equipment. An article of footwear typically includes a sole structure configured to be located under a wearer's foot to space the foot away from the ground. Sole structures in athletic footwear are typically configured to provide cushioning, motion control, and/or resilience.

BRIEF DESCRIPTION OF THE DRAWINGS

The drawings described herein are for illustrative purposes only, are schematic in nature, and are intended to be exemplary rather than to limit the scope of the disclosure.

DETAILED DESCRIPTION

Figure 1:
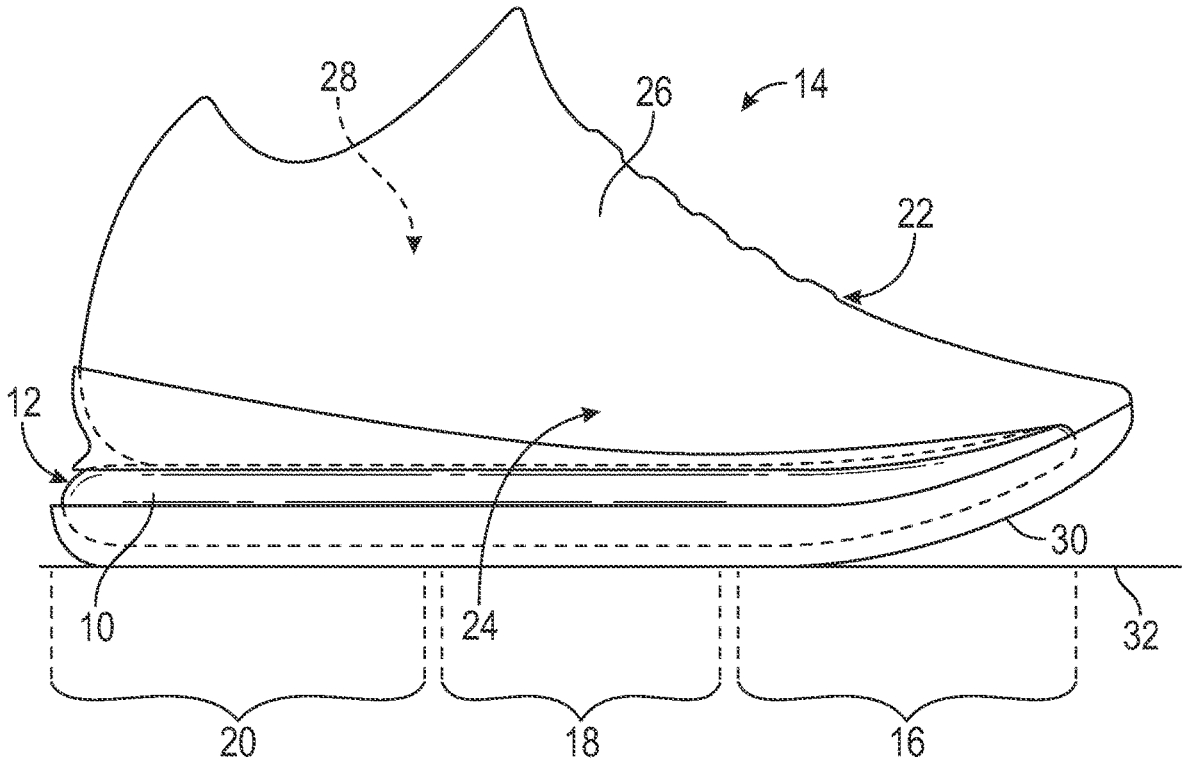
FIG. 1 is a schematic side view of an article of footwear with a sole structure having a fluid filled cushioning component extending across a portion of a heel region, a midfoot region, and a forefoot region.

The present disclosure generally relates to an article of footwear having a sole structure with at least one fiber-reinforced cushioning structure, such as an unfilled bladder or a fluid-filled bladder. As will be discussed below, the use of fiber reinforcement in the bladder walls may enable more direct and directional control over how the bladder expands when inflated or when placed under load. Likewise, the use of fiber reinforcement may enable the bladder to achieve greater internal working pressures, which may result in larger dynamic energy returns to the wearer.

In general, the present fiber reinforcement may be used with cushioning structures comprising two or more stacked polymeric sheets that are selectively bonded together to define an internal volume that may then be inflated and sealed to form a fluid-filled bladder. The polymeric sheets may be bonded together, for example, by increasing the temperature of one or both of the polymeric sheets to or above its softening temperature, (such as by applying heat, ultrasonic energy, radio frequency energy, infrared energy, or any combination thereof, alone or with pressure, to one or both of the substantially planar sheets). For example, the heat or energy applied to one or both of the substantially planar sheets can be sufficient to soften one or both of the polymeric sheets, resulting in a thermal bond between the sheets (and between the sheets and any material(s) positioned between the sheets) once the softened polymeric sheet has re-solidified. Similarly, the heat or energy applied to one or both of the substantially planar sheets can be sufficient to melt at least a portion of one or both of the polymeric sheets to melt, resulting, when re-solidified, a particularly strong thermal bond in which adjacent polymeric materials at least partially fuse with each other, with entanglement of their polymer chains at the fused interface. In some embodiments, this thermal bonding process may occur via a particularly configured die that contacts the polymeric sheets only where the thermal bonds are desired. In other embodiments, a heat press may contact the entire sheet or substantially the entire sheet, while the internal bladder volumes may be formed by regionally inhibiting or blocking the sheets from thermally bonding where the internal volume is desired. In some embodiments, the thermal bonding may be prevented or greatly inhibited by printing or otherwise layering an anti-weld material, such as a "blocker ink", between adjacent surfaces of adjacent sheets. In doing so, applying heat, energy or pressure to the sheets may fuse the sheets only in areas where the anti-weld material is not present. By including the anti-weld material only in internal regions of the sheets (i.e., not extending to an outer perimeter of the sheet), the unfused areas/interstitial spaces may be entirely enclosed such that they are capable of being inflated via introduction of a pressurized fluid. This inflation may cause a transverse separation of the sheets through an elastic expansion of the polymer.

In this bladder construction, the final geometry of the bladder may be a function of both the material properties of the polymeric sheets and the placement/location of anti-weld material/blocker ink between the stacked sheets. More specifically, the resulting location and shape of the bonded areas will define the peripheral contours of the bladder, including the number and existence of any internal chambers, and whether such chambers are in fluidic communication with each other.

In embodiments of the present bladder construction, fiber reinforcement may be added to, or otherwise bonded with, one or more of the polymeric sheets (or select portions thereof) for the purpose of altering the final geometry and/or maximum inflation pressure of the bladder. Inclusion of fiber reinforcement will serve to increase the modulus of elasticity of the sheet in a direction parallel to the fiber. By varying the fiber material, the orientation of the constituent fibers, and the location of the fibers, the expansion/deformation of the sheets during the inflation process may be controlled and/or altered from a simple unreinforced structure.

Referring to the drawings, wherein like reference numbers refer to like components throughout the views, FIG. 1 shows a fluid-filled bladder 10 that is included in a sole structure 12 of an article of footwear 14. The article of footwear 14 may include a forefoot region 16, a midfoot region 18, and a heel region 20, with the midfoot region 18 being located between the heel region 20 and the forefoot region 16. As is understood by those skilled in the art, the forefoot region 16 generally underlies the toes and metatarsal-phalangeal joints of an overlying foot, the midfoot region 18 generally underlies the arch region of the foot, and the heel region 20 generally underlies the calcaneus bone. The article of footwear 14 has a medial side 22 generally shaped to follow the medial side of a wearer's foot, and a lateral side 24 generally shaped to follow the lateral side of the wearer's foot (note that in FIG. 1, the medial side 22 is on the opposite side of the article 14 from what is visible—i.e., the lateral side 24).

In one configuration, the bladder 10 may be assembled as a midsole or a component of a midsole in the sole structure 12. For example, in one configuration, the bladder 10 may be a full-length bladder that extends across each of the forefoot region 16, midfoot region 18 and heel region 20. In some configurations, such a full-length bladder may serve as the entire midsole. In other embodiments, the bladder 10 may be a more discrete cushioning component and/or may comprise a plurality of bladders 10 and may be integrated with one or more foam components to form the midsole. In some examples, such discrete bladders may be located within the forefoot region 16 and/or the heel region 20, but may be omitted from the midfoot region 18.

The sole structure 12 is coupled to a footwear upper 26 that defines an internal foot-receiving cavity 28. Further, the sole structure 12 may include an outsole 30 or outsole surface that is intended to contact the ground or a ground surface 32 when the article 14 is worn by an individual during a normal stride (i.e., while walking or running).

Figure 2A:
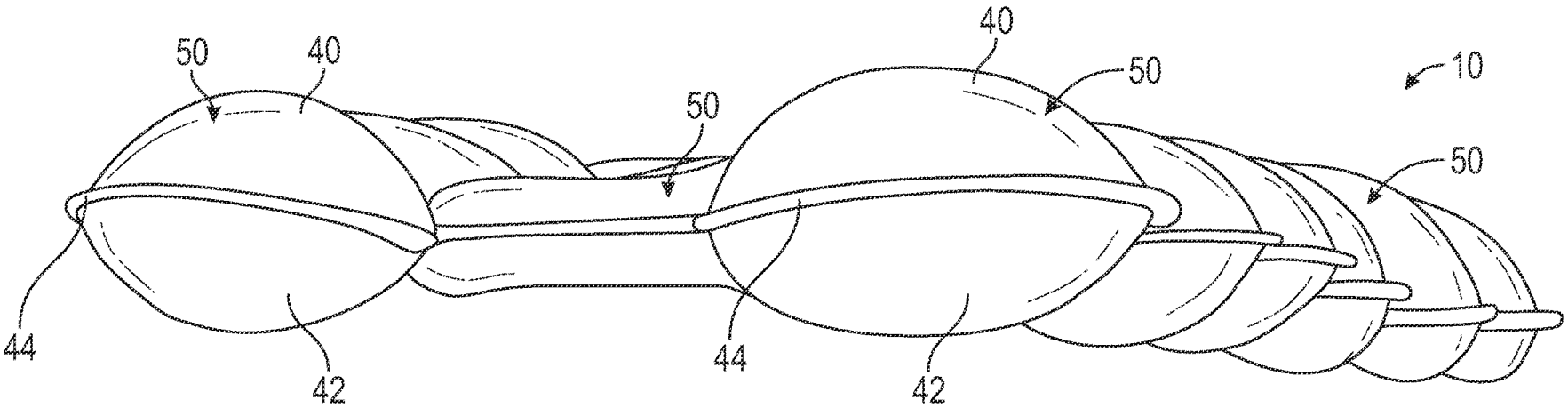
FIG. 2A is a schematic side perspective view of a fluid-filled bladder for use in the sole structure of an article of footwear.
Figure 2B:
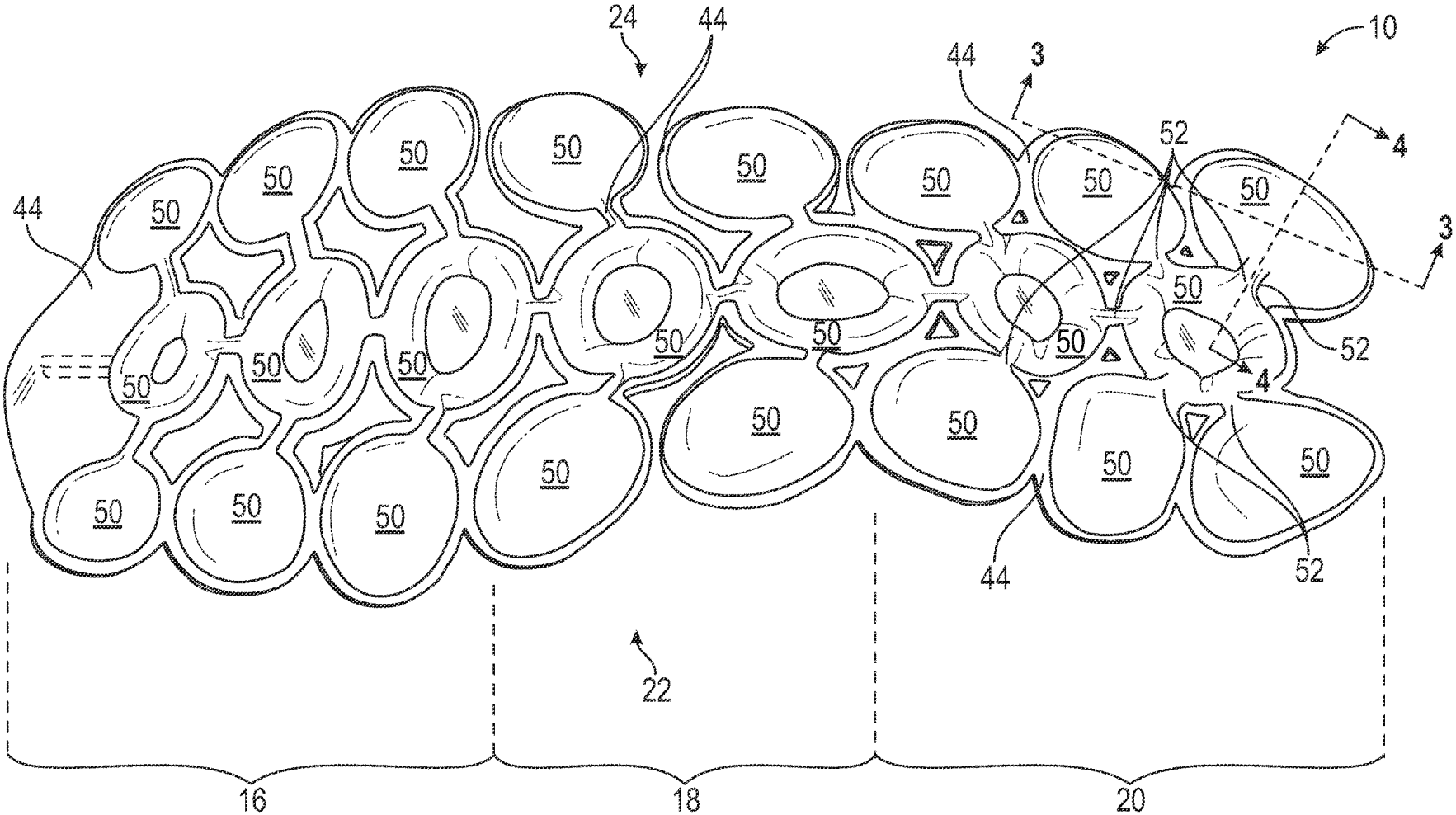
FIG. 2B is a schematic top view of a fluid-filled bladder similar to that shown in FIG. 2A.
Figure 3:
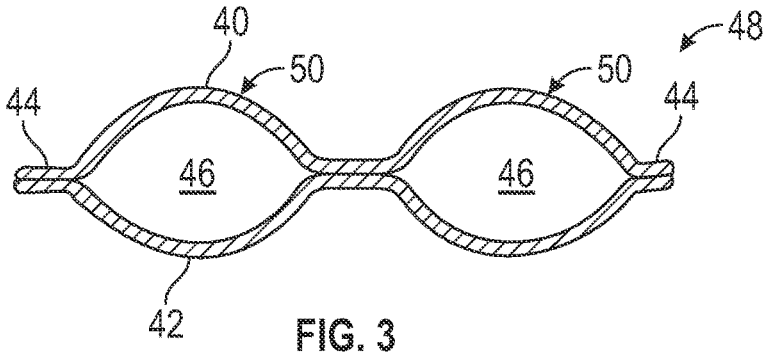
FIG. 3 is a schematic partial cross-sectional view, as may be taken along line 3-3 in FIG. 2B, of a fluid-filled bladder for an article of footwear that has two fluidly isolated chambers.
Figure 4:
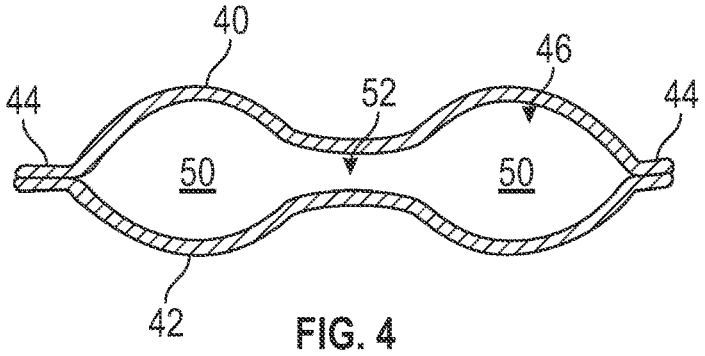
FIG. 4 is a schematic partial cross-sectional view, as may be taken along line 4-4 in FIG. 2B, of a fluid-filled bladder having two fluidly connected chambers.

FIGS. 2A and 2B schematically illustrate one embodiment of a bladder 10 that may be used with the present disclosure. As shown, the bladder 10 may include or be formed between two or more polymeric sheets (e.g., a first polymeric sheet 40 and a second polymeric sheet 42) that are fused together at a peripheral flange 44 to define an internal volume 46 therebetween (such as shown in the cross-section 48 provided in FIG. 3). In some embodiments, such as shown in FIGS. 2B and 4, the internal volume 46 of the bladder 10 may form multiple discrete chambers 50 that may be in fluid communication with each other via one or more internal passageways 52. In some configurations, these passageways 52 may have a narrower diameter or cross-sectional area than the fluidly coupled chamber 50 such that the passageway 52 at least partially restricts the flow of the fluid between connected chambers 50.

Figure 5:
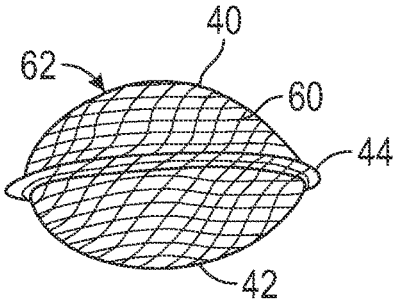
FIG. 5 is a schematic side perspective view of a fluid-filled fiber-reinforced bladder for an article of footwear, where the bladder has a generally symmetric inflation profile.

As schematically illustrated in FIG. 5, in some configurations, one or both of the first polymeric sheet 40 and second polymeric sheet 42 may comprise a plurality of reinforcing fibers 60 that are either embedded within the sheet or else integrally affixed to an outer surface 62 of the respective sheet. In one configuration, the fibers 60 may be embedded within the sheet by creating a multi-layered construction where a plurality of constituent thin-film layers are bonded or otherwise fused together with the fibers existing as one or more intermediate layers provided between adjacent layers of fused polymer.

Figure 6:
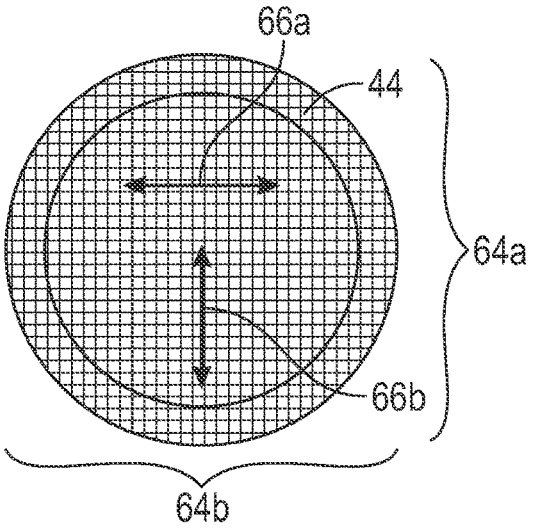
FIG. 6 is a plan view of a fiber-reinforced bladder for an article of footwear, where the bladder has unidirectional reinforcing fibers extending in substantially orthogonal directions.

As generally illustrated in the plan view provided in FIG. 6, in some configurations, the plurality of reinforcing fibers 60 in any polymeric sheet 40, 42 may comprise one or more subsets of unidirectional reinforcing fibers 60. As used herein, a subset of reinforcing fibers 60 is unidirectional if each constituent fiber has a substantially parallel orientation (i.e., where the orientation of a fiber is defined by its longitudinal central axis—generally viewed in a plan view and/or prior to inflation of the bladder 10). As shown in FIG. 6, in one configuration, the plurality of reinforcing fibers 60 in a polymeric sheet may comprise a first subset 64*a* of unidirectional fibers that extend in a first common direction 66*a* and a second subset 64*b* of unidirectional fibers extending in a second common direction 66*b*. The first common direction 64*a* may be oriented at an angle of between about 5 degrees and about 90 degrees relative to the second common direction 64*b*. In one configuration, these directions 64*a*, 64*b* may be approximately orthogonal prior to the bladder being inflated.

While FIG. 6 schematically illustrates only two sets of unidirectional fibers extending in two directions, it should be understood the fiber arrangement is somewhat design driven and a bladder could have 3 or 4 or 5 or even more sets of unidirectional fibers, each having a unique orientation. Moreover, in some embodiments, reinforcing fibers or sets of unidirectional fibers may be woven, wound, or knit in predefined patterns.

When inflated, the bladder may expand at least in part as a function of the material elasticity of the sheet. If reinforcing fibers are oriented to provide the sheet with a substantially isotropic in-plane elastic modulus, then the dimensional expansion of the bladder should be approximately uniform and symmetric, such as shown in FIG. 5. In such an embodiment, the final geometry of the bladder 10 may be similar to a bladder that omits the fibers 60, however, the internal fluid pressure required to achieve an equal or similar transverse deformation would be increased as the modulus of the polymer would also be increased. For example, in a non-fiber reinforced design, the maximum working pressure of the bladder may be approximately 15 to 20 psi, whereas, in the fiber reinforced configuration, the working pressure to achieve a similar shape may be approximately 40 to 50 psi. At the higher working pressures, the bladder may more efficiently return energy to the wearer during actions such as running, jumping, or cutting where a dynamic impact load is applied to the bladder 10.

In many instances, the reinforcing fibers may comprise one or more polymeric materials that have a modulus that is greater than a corresponding modulus of the polymeric sheet material to which it is attached. While in some embodiments, high modulus fibers may be used to effectively lock out or prevent any elastic strain in a given direction, in many embodiments the modulus of the fibers may be selected to only reduce the amount of permitted elastic strain under typical working pressures (while not eliminating it entirely). For example, in some embodiments, the modulus of the fibers may be between 1 and 50 times the modulus of the polymeric sheet absent the fibers. In other embodiments, the modulus of the fibers may be between 1 and 25×, or between 1 and 20×, or between 1 and 10×, or between 1 and 5× the modulus of the polymeric sheet absent the fibers. The fibers should also be flexible enough to permit repeated transverse bending without fracture. This flexibility is important both to permit the initial inflation of the bladder as well as to receive repeated compression during use. In some embodiments, each respective fiber may have a monofilament construction and an aspect ratio of length to diameter of at least 50 or at least 100 or at least 500 or even at least 1000. Said another way, the fibers may be continuous fibers that may each extend across a portion of the final sheet and are not simply a fibrous filler mixed into the polymeric resin prior to forming the sheet.

Figure 7:
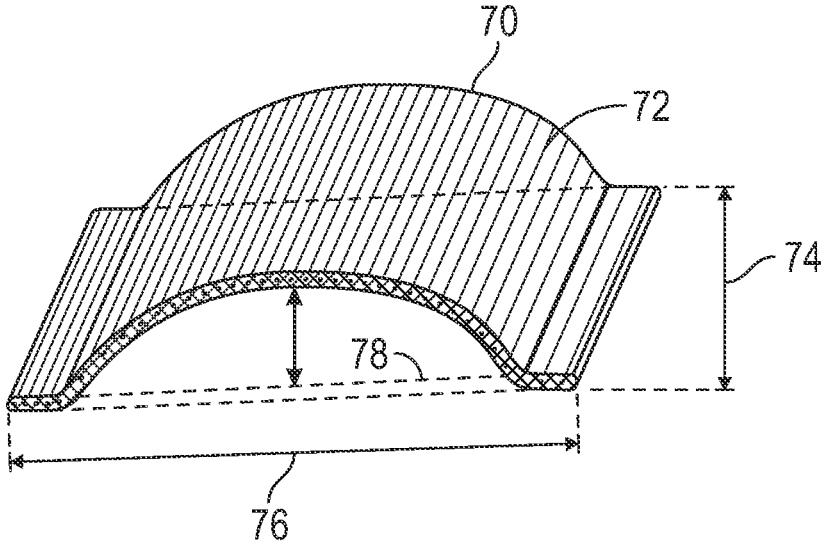
FIG. 7 is a perspective view of a fiber-reinforced polymeric sheet used to form a portion of a bladder for an article of footwear, the sheet including a plurality of unidirectional fibers extending in a single common direction.

While the ability to achieve increased working pressures is one benefit of fiber reinforcement, in other embodiments, the spacing, placement, and/or elasticity of the constituent fibers may be used to alter the inflation dynamics and/or final geometry of the bladder, such as generally shown in at least FIGS. 8-10B. As shown in these examples, the placement of the fibers may enable the modulus of the polymeric sheets to be dimensionally and/or regionally controlled, and/or such that adjacent sheets have different moduli/stretch parameters. In the embodiment shown in FIG. 7, the polymeric sheet 70 includes only a single set of unidirectional fibers 72. In doing so, elastic strain in the dimension 74 parallel to the fibers 72 may be greatly reduced, while the elasticity in the orthogonal dimension 76 may be largely unaffected. This anisotropic in-plane elasticity may greatly affect how the sheet stretches when inflating from a neutral starting position/plane 78, which may be difficult to achieve without relying on engineered material parameters.

Figure 8:
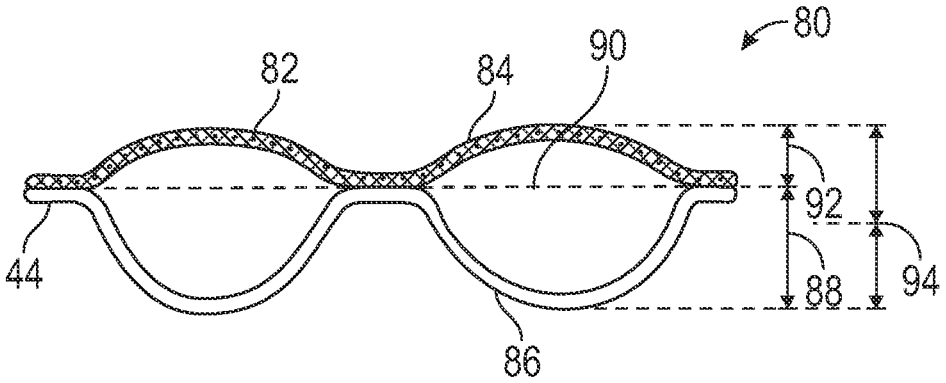
FIG. 8 is a schematic cross-sectional view of a fluid filled bladder for an article of footwear, where the bladder is formed between two polymeric sheets, with one of the sheets including fiber reinforcement to create an asymmetrical profile.

FIG. 8 schematically illustrates a cross-section of a fiber-reinforced bladder 80 that incorporates fiber reinforcement 82 only in one of the two polymeric sheets. In this example, the reinforced sheet 84 may have a greater modulus than the modulus of the unreinforced sheet 86. As such, in response to an introduced internal fluidic pressure, the unreinforced sheet 86 may achieve a greater transverse deformation 88 from a neutral starting plane 90 than a corresponding transverse deformation 92 of the reinforced sheet 84. Said another way, the unreinforced sheet 86 may expand or inflate more than the reinforced sheet 84. This imbalance in the relative inflation deformation may result in the neutral starting plane 90 being shifted apart from a geometric midplane 94 of the inflated bladder—where the neutral starting plane 90 is defined as a plane extending through the peripheral flanges 44 prior to any inflation.

While the example above generally illustrates the edge-to-edge use of fiber reinforcement, in another configuration, the fiber reinforcement may only extend across a portion of the polymeric sheet, such as generally illustrated in FIGS. 9A-12. In doing so, the fiber reinforcement may create unique geometries, portions of the cushioning structure that are seemingly less inflated, and/or isolated volumes at greater internal pressures (depending on whether various chambers are fluidly coupled).

Figure 9A:
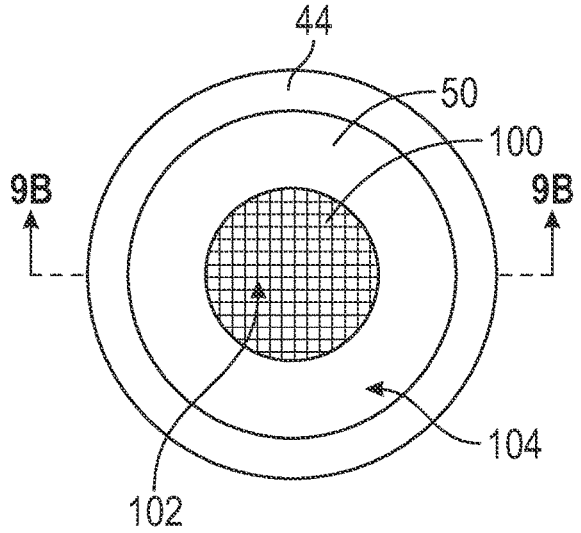
FIG. 9A is a top/plan view of a fiber-reinforced bladder for an article of footwear, where reinforcing fibers are located only in a central region of the bladder with a more peripheral region remaining unreinforced.
Figure 9B:
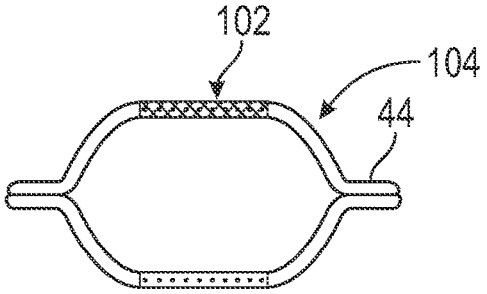
FIG. 9B is a schematic cross-sectional view of the bladder of FIG. 9A, taken along line 9B-9B.

With reference to FIGS. 9A, 9B, 10A, 10B, in some embodiments, the fiber reinforcement may be used to locally control the inflated geometry within a single bladder/chamber 50. For example, as shown in FIGS. 9A-9B, in a circular/spheroid bladder/chamber 50, the reinforcing fibers 100 may be locally placed in a central region 102 of the bladder wall to provide a flatter outward surface, such as generally shown in FIG. 9B. In this design, an unreinforced or lesser reinforced perimeter/peripheral region 104 of the bladder wall may encircle a comparatively more reinforced central region 102 (i.e., where the perimeter region 104 extends between the reinforced central region 102 and the bonded peripheral flange 44). In doing so, the perimeter section 104 may more readily inflate/deform than the central region 102. This may result in the bladder having a greater radius of curvature in the reinforced central region 102 than in the unreinforced peripheral region 104 (i.e., a flatter central region surrounded by a more bulbous/curving peripheral region 104. Such a design may provide benefits by enhancing stability (i.e., providing a flatter contact pad) as well as by enhancing durability (via the fibers) in the area that is likely to receive the most direct loading.

Figure 10A:
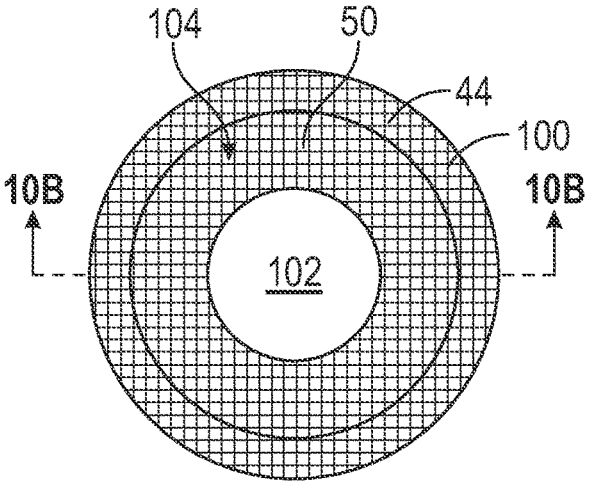
FIG. 10A is a top/plan view of a fiber-reinforced bladder for an article of footwear, where reinforcing fibers are located only in a peripheral region of the bladder with a more central region remaining unreinforced.
Figure 10B:
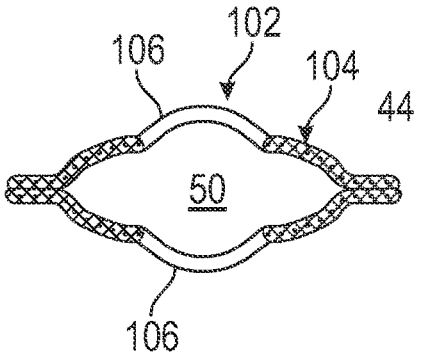
FIG. 10B is a schematic cross-sectional view of the bladder of FIG. 9A, taken along line 10B-10B.

Slightly opposite from the design in FIGS. 9A and 9B, FIGS. 10A and 10B schematically illustrate an embodiment of a similar circular/spheroid bladder, however the fiber reinforcement 100 is provided within the peripheral region 104 while the central region 102 is left un-reinforced. In this design, the unreinforced central region 102 may have a lower modulus, thus making it more susceptible to deformation. When inflated, such as shown in FIG. 10B, the central region 102 may protrude outward with greater prominence than the reinforced peripheral region 104. Such a geometry may create unique tactile sensations for the user if the protruding portion 106 extends upward into contact with the wearer's foot. Otherwise, such a design may create a non-linear stress/strain curve that has a softer initial compression profile (i.e., while the protruding portion 106 initially compresses) followed by a stiffer response as the broader bladder structure is engaged. While FIGS. 9-10 illustrate generally symmetric designs, the same principles can be applied to any bladder configurations, and the reinforcement does not need to be symmetrically applied. For example, the reinforcing fibers could be offset to form a more wedge-like bladder structure. Other designs according to these principles can likewise be created.

Figure 11:
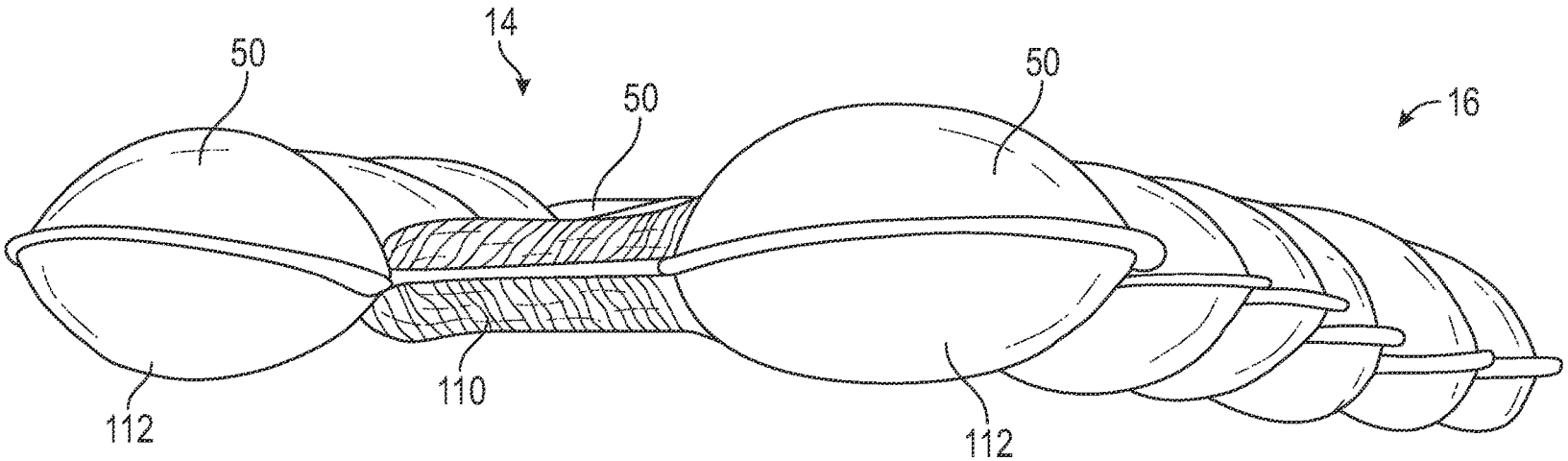
FIG. 11 is a schematic side perspective view of a fluid-filled bladder for an article of footwear, similar to the bladder of FIG. 2A, with a fiber-reinforced central chamber being in fluid communication with unreinforced peripheral chambers.
Figure 12:
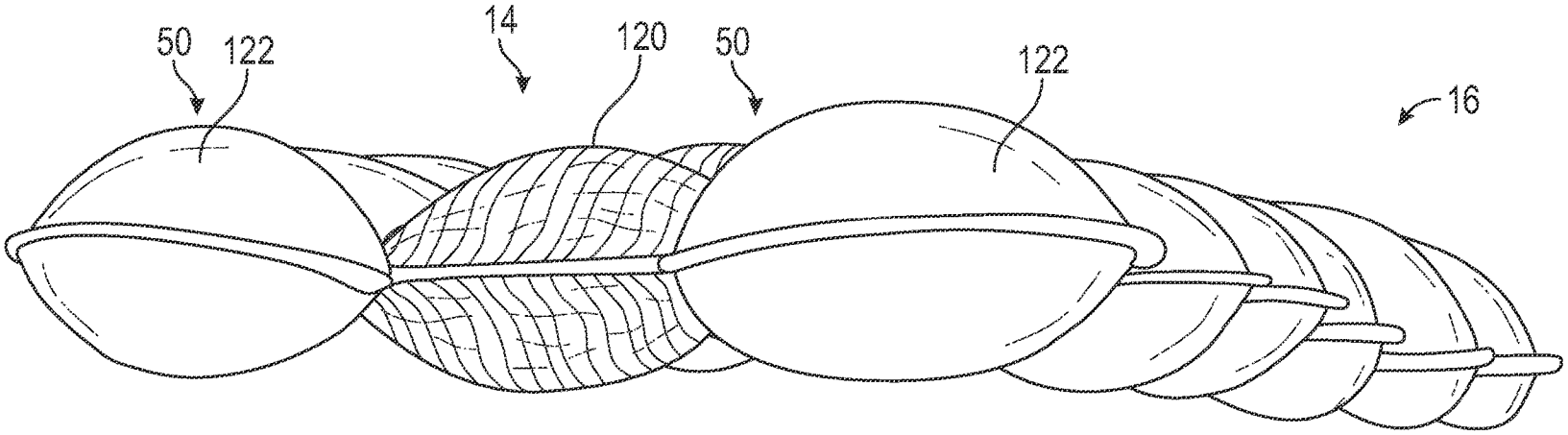
FIG. 12 is a schematic side perspective view of a fluid-filled bladder for an article of footwear, similar to the bladder of FIG. 11, with a fiber-reinforced central chamber being fluidly isolated from unreinforced peripheral chambers.

FIGS. 11-12 schematically illustrate different embodiments of a cushioning structure, similar to that shown in FIG. 2, where select chambers within a bladders structure may be fiber-reinforced. FIG. 11 illustrates an embodiment where the various chambers 50 are fluidly connected via one or more internal passageways, while FIG. 12 illustrates an embodiment where the chambers 50 are fluidly isolated. In the embodiment shown in FIG. 11, due to the internal fluid connectivity, each respective chamber will achieve a common internal pressure under static conditions. That said, a fiber-reinforced central chamber 110 will seemingly inflate/expand less than the unreinforced chambers 112 provided on opposing sides of the reinforced central chamber 110. Conversely, in the embodiment shown in FIG. 12, the respective chambers 50 are each fluidly isolated, with the central chamber 120 including fiber reinforcement while chambers 122 on opposing sides of the reinforced central chamber 120 do not include fiber reinforcement. In this embodiment, the fiber reinforced chamber may have a greater internal pressure to achieve the same amount of relative deformation/inflation as the unreinforced peripheral chambers 122. Such a design may provide greater energy return in the central region, while permitting greater flex/cushioning at the edges.

While FIGS. 11-12 schematically illustrate a central chamber as being reinforced. In other embodiments, the more peripheral chambers may be reinforced while the central chamber is left unreinforced. This may provide greater stability at the edges of the structure while comparatively greater cushioning in the center. Using these techniques, a designer may provide a single cushioning component with varying zonal stiffness to effectively tune the response according to the intended use.

As alluded to above, present techniques/designs may also enable reinforcing fibers of different elasticities to be used in different dimensions/locations across the bladder. For example, in any of FIGS. 9A-12, the "unreinforced areas" may actually be lesser-reinforced areas that include fibers with greater elasticity or varying densities. For example, in one configuration, a first set of unidirectional fibers may have a similar spacing as the fibers within a second set of unidirectional fibers, however the first set may have a different elasticity than the second set. In another embodiment, the first and second set of unidirectional fibers may have similar material properties, though may have differing strand-to-strand spacing/density. In either case, the use of differing fibers and/or spacing may provide the bladder wall with anisotropic material properties, which can be used to create unique bulge profiles upon inflation.

Figure 13:
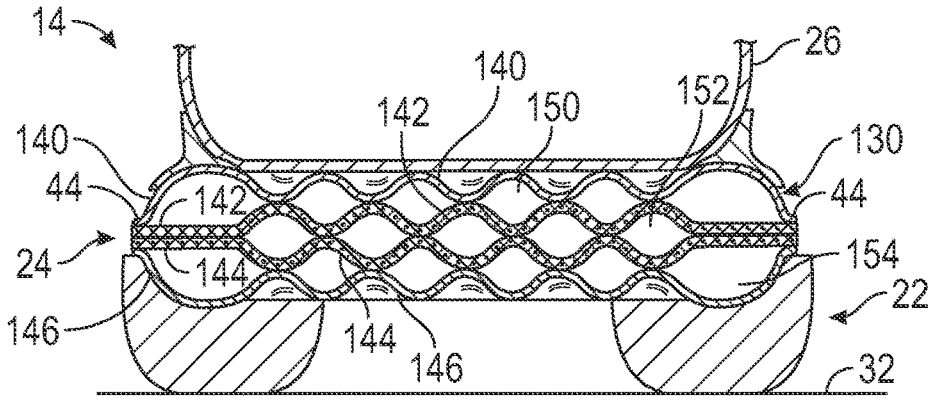
FIG. 13 is a schematic forward facing cross-sectional view of an article of footwear, taken in a medial-lateral plane and illustrating a fluid-filled bladder formed from four polymeric sheets bonded together, where the inner two sheets include fiber reinforcement.

FIG. 13 schematically illustrates a cross-sectional view of a multi-volume bladder 130 that is formed from four stacked polymeric sheets including the first polymeric sheet 140 overlying a second polymeric sheet 142, the second polymeric sheet 142 overlying a third polymeric sheet 144, and the third polymeric sheet 144 overlying a fourth polymeric sheet 146. An outer periphery of each of the four stacked polymeric sheets 140, 142, 144, 146 is bonded to the outer periphery of the other polymeric sheet(s) to define the peripheral flange 44. The four stacked polymeric sheets 140, 142, 144, and 146 may be coextensive, each extending to the peripheral flange 44 and having an outer perimeter at the peripheral flange 44.

With this arrangement of sheets, a first sealed chamber 150 (or collection of chambers 150) is defined and bounded by, and enclosed between, the first and second polymeric sheets 140, 142. A second sealed chamber 152 (or collection of chambers 152) is defined and bounded by, and enclosed between, the second and third polymeric sheets 142, 144. A third sealed chamber 154 (or collection of chambers 154) is defined and bounded by, and enclosed between, the third and fourth polymeric sheets 144, 146. The second sealed chamber 152 is isolated from the first sealed chamber 150 by the second polymeric sheet 142, and the third sealed chamber 154 is isolated from the second sealed chamber 152 by the third polymeric sheet 144. In the embodiment shown, there are only four polymeric sheets and three sealed chambers, in other embodiments, however, there may be more than four stacked polymeric sheets creating more than three sealed chambers (e.g., six stacked polymeric sheets creating five sealed chambers).

In this illustrated embodiment, a progressive cushioning response may be created by designing the outer first and third chambers 150, 154 to have a lower internal pressure than the more centrally located second sealed chamber 152. When compressed, the outer chambers may provide a certain amount of softer deformation prior to engaging the comparatively harder/more pressurized inner core chamber 152. In such an example, the walls of the inner bladder (i.e., the second and third polymeric sheets 142, 144) may have a modulus that is greater than the modulus of the outer sheets that is created via fiber reinforcement provided within these sheets.

In some embodiments connected bladders or "pods" with differing material parameters may be used to create a final cushioning structure that has a unique or engineered geometry. For example, as discussed above with respect to FIG. 8, by placing the fiber reinforcement only on one side of the bladder (i.e., in a single sheet), the bonded flanges 44 of the bladder may be offset from a geometric midplane 94. This may result in a larger unbroken viewable area of the bladder on one side of the flange 44 while achieving a comparatively lower profile on the other side. Such a configuration may be beneficial in a shoe design where a sidewall of the bladder is exposed through, or would otherwise form a portion of the sidewall of the sole structure. More specifically, an offset seam may be more easily hidden from view by other sole. Previously, such a design may have only been possible via thermoforming techniques that typically require dedicated molds and fixtures.

Figure 14:
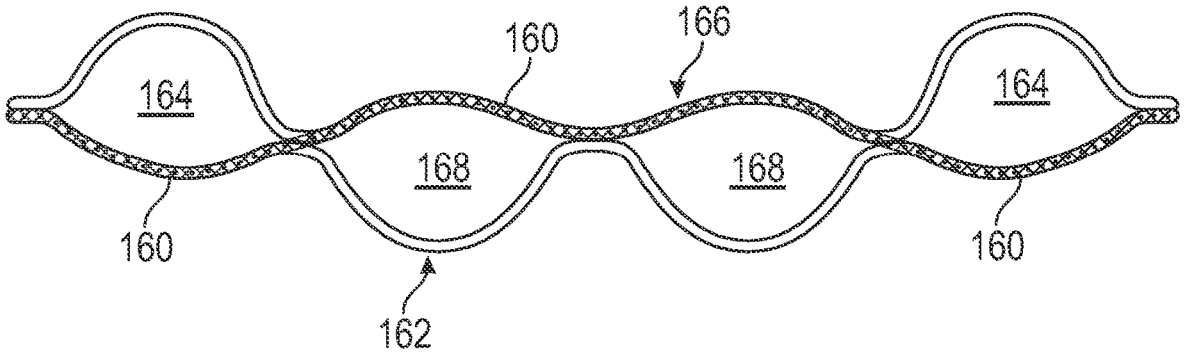
FIG. 14 is a schematic cross-sectional view of a multi-chamber fluid filled bladder for an article of footwear, where fiber reinforcement is included only on a first side of the bladder for centrally located chambers, and only on an opposite, second side of the bladder for more peripherally located chambers.

In another embodiment, the asymmetry discussed with respect to FIG. 8 may also be used to create unique designs/bladder profiles such as generally illustrated in FIG. 14. In this embodiment, the flanges/neutral plane may be curved across the cushioning structure by placing the fiber reinforcement 160 on a first side 162 of the bladder for peripherally situated bladders/chambers 164, while placing the fiber reinforcement on a second side 166 of the bladder (i.e., the opposite bonded sheet) for bladders/chambers that are more centrally disposed 168. As shown, such a configuration may cause the structure (and/or a geometric midline of the bladder structure) to bow around the wearer's foot, which may alter the cushioning response or lateral stability of the sole structure. Such geometric modifications of the overall cushioning structure would be exceedingly difficult with only a 2-sheet bladder construction absent the use of selective reinforcement.

Figure 15:
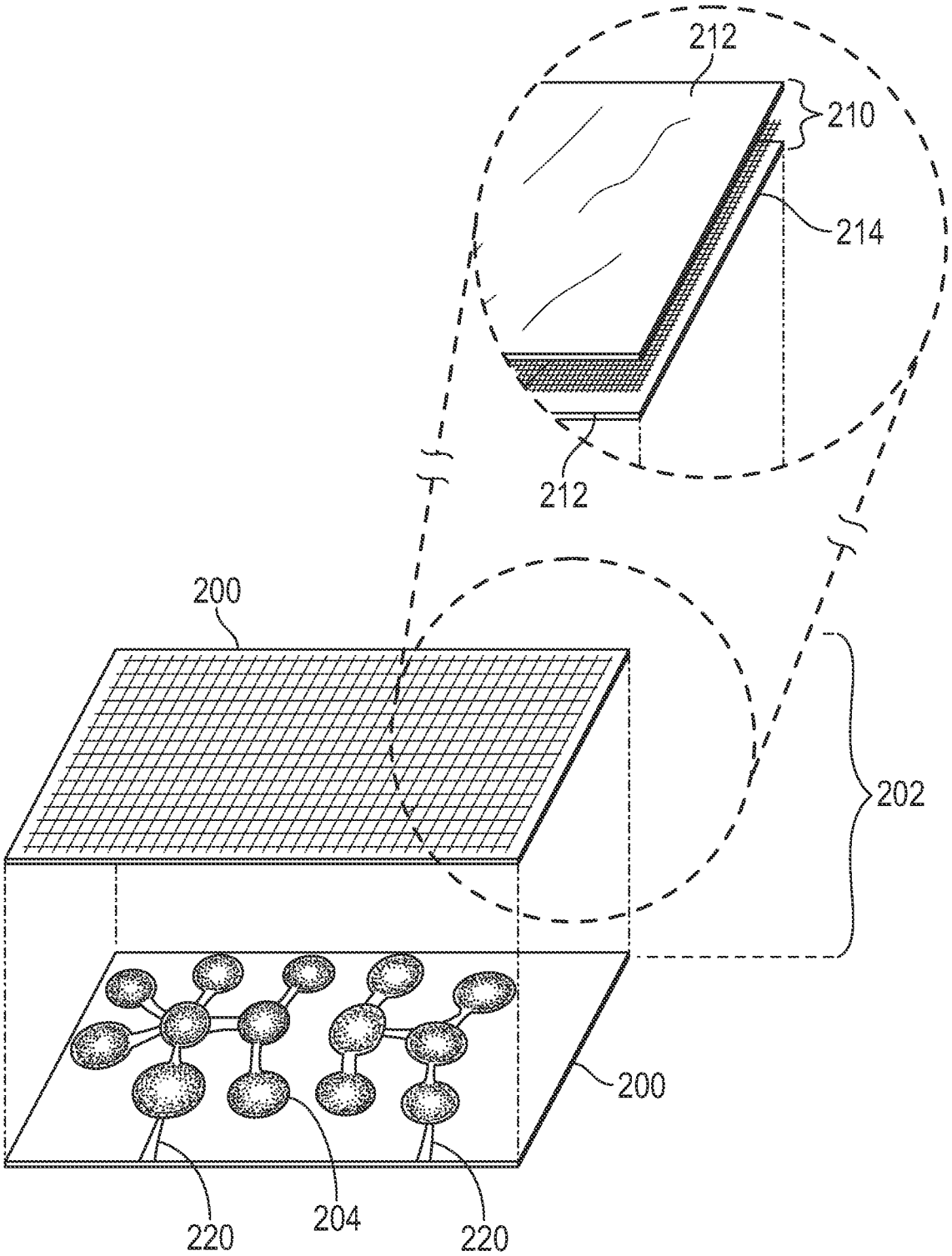
FIG. 15 is a schematic partially exploded view of an assembly used to form a fiber-reinforced, fluid-filled bladder for a sole structure of an article of footwear.

As generally mentioned above, selection of the shape, size, and location of the various bonds between the polymeric sheets as well as the inflation pressures of the chambers and selective fiber reinforcement all cooperate to provide the desired contoured surfaces of the inflated bladder 10. As generally illustrated in FIG. 15, prior to bonding, the polymeric sheets 200 used to form the bladder 10 may be layered as a stacked assembly 202 with anti-weld material 204 applied to, or printed on interfacing surfaces between adjacent sheets 200. As noted above, during the thermal fusing process, the anti-weld material may locally interfere with the ability for adjacent sheets to bond or meld with each other, thus creating internal pockets that may subsequently be filled/pressurized with a working fluid.

As further illustrated in FIG. 15, in some configurations, one or more of the polymeric sheets 200 used to form the final stacked assembly 202 may, itself, be a composite/layered subassembly 210 that is formed from a plurality of constituent polymeric sheets 212 and may further include one or more fiber layers 214 reinforcing fibers that are intended to selectively reinforce some or all of the final polymeric sheet 200. In some embodiments, this sheet subassembly 210 may be fused only during the final fusing process (i.e., of the full assembly 202). In other embodiments, however, the sheet subassembly 210 may be fully or partially formed in its own process prior to the final joining. For example, in some embodiments, the constituent polymeric sheets and interstitial fiber layer 214 may be thermally pressed/fused together as its own process to ensure that the polymer can reflow around and/or bind to the fibers within the fiber layers 214.

With continued reference to FIG. 15, when applied, the anti-weld material 204 may comprise a fluid or fluid-like material (e.g., a blocker ink) that is capable of being selectively deposited on a polymeric sheet 200, such as via an inkjet style printer. In such an example, a computer-controlled print head may selectively deposit/print the blocker ink onto the polymeric sheet according to a programmed pattern (e.g., a bitmap or along a vector-based path) where bonds between adjacent sheets are not desired. During such a layup, the anti-weld material/blocker ink may be inkjet printed onto a first sheet prior to a second sheet being laid across the printed surface of the first sheet.

Once the full stack of alternating sheets and anti-weld material are prepared and assembled, these flat polymeric sheets 200 may then be selectively and/or uniformly heat pressed to cause unblocked adjacent surfaces to thermally bond or weld together. As noted above, during this process, the anti-weld material interferes with the ability for the sheets to thermally bond wherever the anti-weld material is placed. No thermoforming molds or radio frequency welding is necessary to form the bladder 10 according to this method. Likewise, if the sheets 200 are uniformly heat pressed together (e.g., such as via a heated iron or planar press, there may be no need to re-tool or reconfigure a workstation to generate a different bladder configuration. All that would need to occur would be to print a different pattern of anti-weld material.

Once bonded, the polymeric sheets 200 remain flat and take on the contoured shape of the bladder 10 only when the internal chambers 50 are inflated via a fluid (e.g., an inflation gas) introduced via provided fill ports 220 (i.e., shown as printed anti-weld material 204 in FIG. 15). Once the internal chambers 50 are sufficiently inflated/pressurized, the fill ports 220 may be subsequently sealed to trap the fluid within the internal volume thus maintaining the inflated bladder shape. If the inflation gas is removed without sealing the fill ports 220, and assuming other components are not disposed in any of the sealed chambers, and the polymeric sheets 200 are not yet bonded to other components such as an outsole, other midsole layers, or an upper, the polymeric sheets 200 would likely return to their initial, flat state (assuming no creep or plastic strain results from the inflation).

The polymeric sheets 200 (and/or constituent sheets 212) can be formed from a variety of materials including various polymers that can resiliently retain a fluid such as air or another gas. In one aspect, the polymeric sheets 200 and/or constituent sheets 212 used to form the airbags or bladders disclosed herein comprise or consist of a barrier membrane. As used herein, a barrier membrane is understood to be a membrane having a relatively low rate of transmittance of a fluid. When used alone or in combination with other materials in an airbag or bladder, the barrier membrane resiliently retains the fluid. Depending upon the structure and use of the airbag or bladder, the barrier membrane may retain the fluid at a pressure which is above, at, or below atmospheric pressure. In some aspects, the fluid is a liquid or a gas. Examples of gasses include air, oxygen gas ($O_2$), and nitrogen gas ($N_2$), as well as inert gasses. In one aspect, the barrier membrane is a nitrogen gas barrier material.

The gas transmission rate of the barrier membrane can be less than 4 or less than 3 or less than 2 cubic centimeters per square meter per atmosphere per day per day for a membrane having a thickness of from about 72 micrometers to about 320 micrometers, as measured at 23 degrees Celsius and 0 percent relative humidity. In another example, the gas transmission rate of the barrier membrane is from about 0.1 to about 3, or from about 0.5 to about 3, or from about 0.5 to about 3 cubic centimeters per square meter per atmosphere per day per day for a membrane having a thickness of from about 72 micrometers to about 320 micrometers, as measured at 23 degrees Celsius and 0 percent relative humidity. The gas transmission rate, such as the oxygen gas or nitrogen gas transmission rate, can be measured using ASTM D1434.

In one aspect, the barrier membrane may comprise a multi-layered film comprising a plurality of layers, the plurality of layers comprising one or more barrier layers, the one or more barrier layers comprising a barrier material, the barrier material comprising or consisting essentially of one or more gas barrier compounds. The multi-layered film comprises at least 5 layers or at least 10 layers. Optionally, the multi-layered film comprises from about 5 to about 200 layers, from about 10 to about 100 layers, from about 20 to about 80 layers, from about 20 to about 50 layers, or from about 40 to about 90 layers.

In one aspect of a multi-layered film, the plurality of layers includes a series of alternating layers, in which the alternating layers include two or more barrier layers, each of the two or more barrier layers individually comprising a barrier material, the barrier material comprising or consisting essentially of one or more gas barrier compounds. In the series of alternating layers, adjacent layers are individually formed of materials which differ from each other at least in their chemical compositions based on the individual components present (e.g., the materials of adjacent layers may differ based on whether or not a gas barrier compound is present, or differ based on class or type of gas barrier compound present), the concentration of the individual components present (e.g., the materials of adjacent layers may differ based on the concentration of a specific type of gas barrier compound present), or may differ based on both the components present and their concentrations.

The plurality of layers of the multi-layered film can include first barrier layers comprising a first barrier material and second barrier layers comprising a second barrier material, wherein the first and second barrier materials differ from each other based as described above. The first barrier material can be described as comprising a first gas barrier component consisting of all the gas barrier compounds present in the first barrier material, and the second barrier material can be described as comprising a second barrier material component consisting of all the gas barrier compounds present in the second barrier material. In a first example, the first barrier component consists only of one or more gas barrier polymers, and the second barrier component consists only of one or more inorganic gas barrier compounds. In a second example, the first barrier component consists of a first one or more gas barrier polymers, and the second component consists of a second one or more gas barrier polymers, wherein the first one or more gas barrier polymers differ from the second one or more gas barrier polymers in polymer class, type, or concentration. In a third example, the first barrier component and the second barrier component both include the same type of gas barrier compound, but the concentration of the gas barrier compound differ, optionally the concentrations differ by at least 5 weight percent based on the weight of the barrier material. In these multi-layered films, the first barrier layers and the second barrier layers can alternate with each other, or can alternate with additional barrier layers (e.g., third barrier layers comprising a third barrier material, fourth barrier layers comprising a fourth barrier material, etc., wherein each of the first, second, third and fourth, etc., barrier materials differ from each other as described above.

The barrier material (including a first barrier material, a second barrier material, etc.) has a low gas transmittance rate. For example, when formed into a single-layer film consisting essentially of the barrier material, the single-layer film has a gas transmittance rate of less than 4 cubic centimeters per square meter per atmosphere per day per day for a membrane having a thickness of from about 72 micrometers to about 320 micrometers, as measured at 23 degrees Celsius and 0 percent relative humidity, and can be measured using ASTM D1434. The barrier material comprises or consists essentially of one or more gas barrier compounds. The one or more gas barrier compounds can comprise one or more gas barrier polymers, or can comprise one or more inorganic gas barrier compound, or can comprise a combination of at least one gas barrier polymer and at least one inorganic gas barrier compound. The combination of at least one gas barrier polymer and at least one inorganic gas barrier compound can comprise a blend or mixture, or can comprise a composite in which fibers, particles or platelets of the inorganic gas barrier compound are surrounded by the gas barrier polymer.

In one aspect, the barrier material comprises or consists essentially of one or more inorganic gas barrier compounds. The one or more inorganic gas barrier compounds can take the form of fibers, particulates, platelets, or combinations thereof. The fibers, particulates, platelets can comprise or consist essentially of nanoscale fibers, particulates, platelets, or combinations thereof. Examples of inorganic barrier compounds includes, for example, carbon fibers, glass fibers, glass flakes, silicas, silicates, calcium carbonate, clay, mica, talc, carbon black, particulate graphite, metallic flakes, and combinations thereof. The inorganic gas barrier component can comprise or consist essentially of one or more clays. Examples of suitable clays include bentonite, montmorillonite, kaolinite, and mixtures thereof. In one example, the inorganic gas barrier component consists of clay. Optionally, the barrier material can further comprise one or more additional ingredients, such as a polymer, processing aid, colorant, or any combination thereof. In aspects where the barrier material comprises or consists essentially of one or more inorganic barrier compounds, the barrier material can be described as comprising an inorganic gas barrier component consisting of all inorganic barrier compounds present in the barrier material. When one or more inorganic gas barrier compounds are included in the barrier material, the total concentration of the inorganic gas barrier component present in the barrier material can be less than 60 weight percent, or less than 40 weight percent, or less than 20 weight percent of the total composition. Alternatively, in other examples, the barrier material consists essentially of the one or more inorganic gas barrier materials.

In one aspect, the gas barrier compound comprises or consists essentially of one or more gas barrier polymers. The one or more gas barrier polymers can include thermoplastic polymers. In one example, the barrier material can comprise or consist essentially of one or more thermoplastic polymers, meaning that the barrier material comprises or consists essentially of a plurality of thermoplastic polymers, including thermoplastic polymers which are not gas barrier polymers. In another example, the barrier material comprises or consists essentially of one or more thermoplastic gas barrier polymers, meaning that all the polymers present in the barrier material are thermoplastic gas barrier polymers. The barrier material can be described as comprising a polymeric component consisting of all polymers present in the barrier material. For example, the polymeric component of the barrier material can consist of a single class of gas barrier polymer, such as, for example, one or more polyolefin, or can consist of a single type of gas barrier polymer, such as one or more ethylene-vinyl alcohol copolymers. Optionally, the barrier material can further comprise one or more non-polymeric additives, such as one or more filler, processing aid, colorant, or combination thereof.

Many gas barrier polymers are known in the art. Examples of gas barrier polymers include vinyl polymers such as vinylidene chloride polymers, acrylic polymers such as acrylonitrile polymers, polyamides, epoxy polymers, amine polymers, polyolefins such as polyethylenes and polypropylenes, copolymers thereof, such as ethylene-vinyl alcohol copolymers, and mixtures thereof. Examples of thermoplastic gas barrier polymers include thermoplastic vinyl homopolymers and copolymers, thermoplastic acrylic homopolymers and copolymers, thermoplastic amine homopolymers and copolymers, thermoplastic polyolefin homopolymers and copolymers, and mixtures thereof. In one example, the one or more gas barrier polymers comprise or consist essentially of one or more thermoplastic polyethylene copolymers, such as, for example, one or more thermoplastic ethylene-vinyl alcohol copolymers. The one or more ethylene-vinyl alcohol copolymers can include from about 28 mole percent to about 44 mole percent ethylene content, or from about 32 mole percent to about 44 mole percent ethylene content. In yet another example, the one or more gas barrier polymers can comprise or consist essentially of one or more one or more polyethyleneimine, polyacrylic acid, polyethyleneoxide, polyacrylamide, polyamidoamine, or any combination thereof.

In another aspect, in addition to the one or more barrier layers (e.g., including first barrier layers, second barrier layers, etc.), the multi-layered film further comprises one or more second layers, the one or more second layers comprising a second material. In one such configuration of the multi-layered film, the one or more barrier layers include a plurality of barrier layers alternating with a plurality of second layers. For example, each of the one or more barrier layers may be positioned between two second layers (e.g., with one second layer positioned on a first side of the barrier layer, and another second layer on a second side of the barrier layer, the second side opposing the first side).

The second material of the one or more second layers can comprise one or more polymers. Depending upon the class of gas barrier compounds used and the intended use of the multi-layered film, the second material may have a higher gas transmittance rate than the barrier material, meaning that the second material is a poorer gas barrier than the barrier material. In some aspects, the one or more second layers act as substrates for the one or more barrier layers, and may serve to increase the strength, elasticity, and/or durability of the multi-layered film. Alternatively or additionally, the one or more second layers may serve to decrease the amount of gas barrier material(s) needed, thereby reducing the overall material cost. Even when the second material has a relatively high gas transmittance rate, the presence of the one or more second layers, particularly when the one or more second layers are positioned between one or more barrier layers, may help maintain the overall barrier properties of the film by increasing the distance between cracks in the barrier layers, thereby increasing the distance gas molecules must travel between cracks in the barrier layers in order to pass through the multi-layered film. While small fractures or cracks in the barrier layers of a multi-layered film may not significantly impact the overall barrier properties of the film, using a larger number of thinner barrier layers can avoid or reduce visible cracking, crazing or hazing of the multi-layered film. The one or more second layers can include, but are not limited to, tie layers adhering two or more layers together, structural layers providing mechanical support to the multi-layered films, bonding layers providing a bonding material such as a hot melt adhesive material to the multi-layered film, and/or cap layers providing protection to an exterior surface of the multi-layered film.

In some aspects, the second material is an elastomeric material comprising or consisting essentially of at least one elastomer. Many gas barrier compounds are brittle and/or relatively inflexible, and so the one or more barrier layers may be susceptible to cracking when subjected to repeated, excessive stress loads, such as those potentially generated during flexing and release of a multi-layered film. A multi-layered film which includes one or more barrier layers alternating with second layers of an elastomeric material results in a multi-layered film that is better able to withstand repeated flexing and release while maintaining its gas barrier properties, as compared to a film without the elastomeric second layers present.

The second material comprises or consists essentially of one or more polymers. As used herein, the one or more polymers present in the second material are referred to herein as one or more "second polymers" or a "second polymer", as these polymers are present in the second material. References to "second polymer(s)" are not intended to indicate that a "first polymer" is present, either in the second material, or in the multi-layered film as a whole, although, in many aspects, multiple classes or types of polymers are present. In one aspect, the second material comprises or consists essentially of one or more thermoplastic polymers. In another aspect, the second material comprises or consists essentially of one or more elastomeric polymers. In yet another aspect, the second material comprises or consists essentially of one or more thermoplastic elastomers. The second material can be described as comprising a polymeric component consisting of all polymers present in the second material. In one example, the polymeric component of the second material consists of one or more elastomers. Optionally, the second material can further comprise one or more non-polymeric additives, such as fillers, processing aids, and/or colorants.

Many polymers which are suitable for use in the second material are known in the art. Exemplary polymers which can be included in the second material (e.g., second polymers) include polyolefins, polyamides, polycarbonates, polyimines, polyesters, polyacrylates, polyesters, polyethers, polystyrenes, polyureas, and polyurethanes, including homopolymers and copolymers thereof (e.g., polyolefin homopolymers, polyolefin copolymers, etc.), and combinations thereof. In one example, the second material comprises or consists essentially of one or more polymers chosen from polyolefins, polyamides, polyesters, polystyrenes, and polyurethanes, including homopolymers and copolymers thereof, and combinations thereof. In another example, the polymeric component of the second material consists of one or more thermoplastic polymers, or one or more elastomers or one or more thermoplastic elastomers, including thermoplastic vulcanizates. Alternatively, the one or more second polymers can include one or more thermoset or thermosettable elastomers, such as, for example, natural rubbers and synthetic rubbers, including butadiene rubber, isoprene rubber, silicone rubber, and the like.

Polyolefins are a class of polymers which include monomeric units derived from simple alkenes, such as ethylene, propylene and butene. Examples of thermoplastic polyolefins include polyethylene homopolymers, polypropylene homopolymers polypropylene copolymers (including polyethylene-polypropylene copolymers), polybutene, ethylene-octene copolymers, olefin block copolymers; propylene-butane copolymers, and combinations thereof, including blends of polyethylene homopolymers and polypropylene homopolymers. Examples of polyolefin elastomers include polyisobutylene elastomers, poly(alpha-olefin) elastomers, ethylene propylene elastomers, ethylene propylene diene monomer elastomers, and combinations thereof.

Polyamides are a class of polymers which include monomeric units linked by amide bonds. Naturally-occurring polyamides include proteins such as wool and silk, and synthetic amides such as nylons and aramids. The one or more second polymers can include thermoplastic polyamides such as nylon 6, nylon 6-6, nylon-11, as well as thermoplastic polyamide copolymers.

Polyesters are a class of polymers which include monomeric units derived from an ester functional group, and are commonly made by condensing dibasic acids such as, for example, terephthalic acid, with one or more polyols. In one example, the second material can comprise or consist essentially of one or more thermoplastic polyester elastomers. Examples of polyester polymers include homopolymers such as polyethylene terephthalate, polybutylene terephthalate, poly-1,4-cyclohexylene-dimethylene terephthalate, as well as copolymers such as polyester polyurethanes.

Styrenic polymers are a class of polymers which include monomeric units derived from styrene. The one or more second polymers can comprise or consist essentially of styrenic homopolymers, styrenic random copolymers, styrenic block copolymers, or combinations thereof. Examples of styrenic polymers include styrenic block copolymers, such as acrylonitrile butadiene styrene block copolymers, styrene acrylonitrile block copolymers, styrene ethylene butylene styrene block copolymers, styrene ethylene butadiene styrene block copolymers, styrene ethylene propylene styrene block copolymers, styrene butadiene styrene block copolymers, and combinations thereof.

Polyurethanes are a class of polymers which include monomeric units joined by carbamate linkages. Polyurethanes are most commonly formed by reacting a polyisocyanate (e.g., a diisocyanate or a triisocyanate) with a polyol (e.g., a diol or triol), optionally in the presence of a chain extender. The monomeric units derived from the polyisocyanate are often referred to as the hard segments of the polyurethane, while the monomeric units derived from the polyols are often referred to as the soft segments of the polyurethane. The hard segments can be derived from aliphatic polyisocyanates, or from organic isocyanates, or from a mixture of both. The soft segments can be derived from saturated polyols, or from unsaturated polyols such as polydiene polyols, or from a mixture of both. When the multi-layered film is to be bonded to natural or synthetic rubber, including soft segments derived from one or more polydiene polyols can facilitate bonding between the rubber and the film when the rubber and the film are crosslinked in contact with each other, such as in a vulcanization process.

Examples of suitable polyisocyanates from which the hard segments of the polyurethane can be derived include hexamethylene diisocyanate (HDI), isophorone diisocyanate (IPDI), butylenediisocyanate (BDI), bisisocyanatocyclohexylmethane (HMDI), 2,2,4-trimethylhexamethylene diisocyanate (TMDI), bisisocyanatomethylcyclohexane, bisisochanatomethyltricyclodecane, norbornane diisocyanate (NDI), cyclohexane diisocyanate (CHDI), 4,4'-dicyclohexhylmethane diisocyanate (H12MDI), diisocyanatododecane, lysine diisocyanate, toluene diisocyanate (TDI), TDI adducts with trimethylolpropane (TMP), methylene diphenyl diisocyanate (MDI), xylene diisocyanate (XDI), tetramethylxylylene diisocyanate (TMXDI), hydrogenated xylene diisocyanate (HXDI), naphthalene 1,5-diisocyanate (NDI), 1,5-tetrahydronaphthalene diisocyanate, para-phenylene diisocyanate (PPDI), 3,3'-dimethyldiphenyl-4,4'-diisocyanate (DDDI), 4,4'-dibenzyl diisocyanate (DBDI), 4-chloro-1,3-phenylene diisocyanate, and any combination thereof. In one aspect, the polyurethane comprises or consists essentially of hard segments derived from toluene diisocyanate (TDI), or from methylene diphenyl diisocyanate (MDI), or from both.

The soft segments of the polyurethane can be derived from a wide variety of polyols, including polyester polyols, polyether polyols, polyester-ether polyols, polycarbonate polyols, polycaprolactone polyethers, and combinations thereof. In one aspect, the polyurethane comprises or consist essentially of monmeric units derived from $C_4$-$C_{12}$ polyols, or $C_6$-$C_{10}$ polyols, or $C_8$ or lower polyols, meaning polyols with 4 to 12 carbon molecules, or with 6 to 10 carbon molecules, or with 8 or fewer carbon molecules in their chemical structures. In another aspect, the polyurethane comprises or consists essentially of monomeric units derived from polyester polyols, polyester-ether polyols, polyether polyols, and any combination thereof. In yet another aspect, the polyurethane comprises or consists essentially of soft segments derived from polyols or diols having polyester functional units. The soft segments derived from polyols or diols having polyester functional units can comprise about 10 to about 50, or about 20 to about 40, or about 30 weight percent of the soft segments present in the polyurethane.

The multi-layered films can be produced by various means such as co-extrusion, lamination, layer-by-layer deposition, and the like. When co-extruding one or more barrier layers alone or with one or more second layers, selecting materials (e.g., a first barrier material and a second barrier material, or a single barrier material and a second material) having similar processing characteristics such as melt temperature and melt flow index, can reduce interlayer shear during the extrusion process, and can allow the alternating barrier layers and second layers to be co-extruded while retaining their structural integrities and desired layer thicknesses. In one example, the one or more barrier materials and optionally the second material when used, can be extruded into separate individual films, which can then be laminated together to form the multi-layered films.

The multi-layered films can be produced using a layer-by-layer deposition process. A substrate, which optionally can comprise a second material or a barrier material, can be built into a multi-layered film by depositing a plurality of layers onto the substrate. The layers can include one or more barrier layers (e.g., first barrier layers, second barrier layers, etc.). Optionally, the layers can include one or more second layers. The one or more barrier layers and/or second layers can be deposited by any means known in the art such as, for example, dipping, spraying, coating, or another method. The one or more barrier layers can be applied using charged solutions or suspensions, e.g., cationic solutions or suspensions or anionic solutions or suspensions, including a charged polymer solution or suspension. The one or more barrier layers can be applied using a series of two or more solutions having opposite charges, e.g., by applying a cationic solution, followed by an anionic solution, followed by a cationic solution, followed by an anionic solution, etc.

The barrier membranes, including the multi-layered films, have an overall thickness of from about 40 micrometers to about 500 micrometers, or about 50 micrometers to about 400 micrometers, or about 60 micrometers to about 350 micrometers. In one aspect, each individual layer of the plurality of layers of the multi-layered film has a thickness of from about 0.001 micrometers to about 10 micrometers. For example, the thickness of an individual barrier layer can range from about 0.001 micrometers to about 3 micrometers thick, or from about 0.5 micrometers to about 2 micrometers thick, or from about 0.5 micrometers to about 1 micrometer thick. The thickness of an individual second layer can range from about 2 micrometers to about 8 micrometers thick, or from about 2 micrometers to about 4 micrometers thick. In a further aspect, thickness of the films and/or their individual layers can be measured by any method known in the art such as, for example, ASTM E252, ASTM D6988, ASTM D8136, or using light microscopy or electron microscopy.

In some aspects, the barrier membranes, including the multi-layered films, have a Shore hardness of from about 35A to about 95A, optionally from about 55A to about 90A. In these aspects, hardness can be measured using ASTM D2240 using the Shore A scale.

In one aspect, when a co-extrusion process is used to form the barrier membrane from a plurality of alternating barrier layers and second layers, the barrier material has a melt flow index of from about 5 to about 7 grams per 10 minutes at 190 degrees Celsius when using a weight of 2.16 kilograms, while the second material has a melt flow index of from about 20 to about 30 grams per 10 minutes at 190 degrees Celsius when using a weight of 2.16 kilograms. In a further aspect, the melt flow index of the barrier material is from about 80 percent to about 120 percent of the melt flow index of the barrier material per 10 minutes when measured at 190 degrees Celsius when using a weight of 2.16 kilograms. In these aspects, melt flow index can be measured using ASTM D1238. Alternatively or additionally, the barrier material or the second material or both have a melting temperature of from about 165 degrees Celsius to about 183 degrees Celsius, or from about 155 degrees Celsius to about 165 degrees Celsius. In one such example, the barrier material has a melting temperature of from about 165 degrees Celsius to about 183 degrees Celsius, while the second material has a melting temperature of from about 155 degrees Celsius to about 165 degrees Celsius. Further in these aspects, melting temperature can be measured using ASTM D3418.

In some embodiments, the reinforcing fibers may be formed from a polymeric material such as an aramid, a polyester, a thermoplastic polyurethane, an Ethylene vinyl alcohol (EVOH) material, an ultra-high-molecular-weight polyethylene, or a polyamide material. In other embodiments, the fibers may comprise carbon fibers, glass spun fibers, and the like, provided that the fiber can meet certain minimum durability requirements given the expected use.

While it is possible for each constituent fiber to be individually laid down, manufacturing efficiency and production cycle time may be improved if the fibers are collectively positioned across the polymeric sheet. Collective positioning may be accomplished through the use of unidirectional fiber plies, layups formed from a plurality of unidirectional fiber plies (i.e., each having a different common orientation), woven fabrics, or knit fabrics. In some embodiments, the fiber layer may comprise its own discrete layer within the full sheet assembly/stackup 202. In such an instance, it may be beneficial for the respective fiber layer (i.e., unidirectional fiber ply, stackup of unidirectional fiber plies, woven fabric, or other fiber assembly) to be impregnated with a thermoplastic material prior to being fused.

In some embodiments, fibers or fiber designs may provide non-linear stretch profiles such that the effective modulus of the fibers significantly increases after some amount of strain. These fiber configurations may include the use of materials having non-linear elasticities, loosely woven or knit yarns, lock out fibers, coiled fibers, and the like. With a nonlinear stretch profile, bladder may more easily inflate during in initial introduction of pressurized fluid, however once the threshold inflation has been reached, the lockout fibers or fiber design may engage/stiffen and aid in resisting further inflation.

In some embodiments, in addition to structurally reinforcing the bladder, the fiber layers may be used to aid in affixing the bladder/cushioning structure to adjacent components. For example, in one configuration, the fibers may be provided near an outer surface of the polymeric sheet and used to knit, weave, or stitch the bladder to an adjacent textile. In some embodiments, anti-weld material may be selectively printed (dotted) on the polymeric sheet prior to laying down the outer-layer fibers. In doing so, when the assembly is finally pressed, there may be areas of the fiber layer that do not directly bond with the adjacent polymeric sheet. In such a design, these unattached fibers/sections of fiber may be used as loops that can be accessed without a substantial risk of piercing the bladder wall and letting the pressurized fluid escape.

Figure 16A:
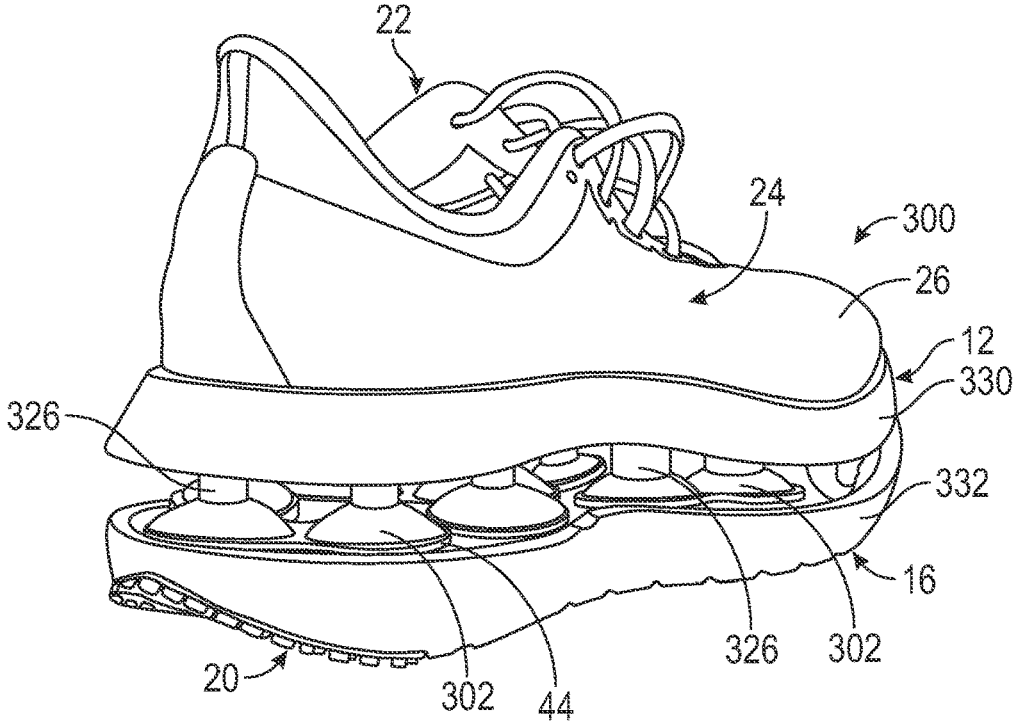
FIG. 16A is a schematic rear-side perspective view of an article of footwear that includes a sole structure having a plurality of discrete fiber-reinforced bladders.
Figure 16B:
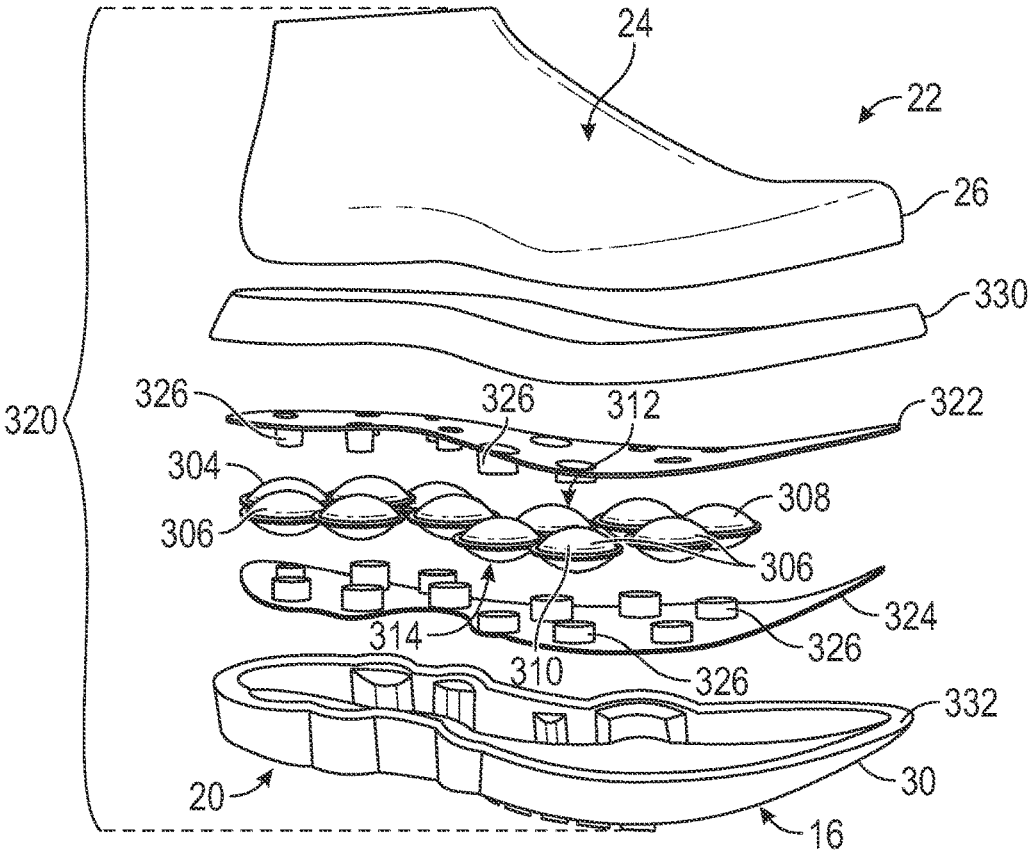
FIG. 16B is a schematic exploded view of the article of footwear of FIG. 16A.

FIGS. 16A and 16B schematically illustrate an article of footwear 300 with a sole structure 12 having a plurality of discrete, fiber reinforced bladders 302. In the embodiment shown, three pods of fluidly connected bladders/chambers are provided. A first bladder pod 304 with six discrete chambers 306 is provided in the heel region 20 of the sole structure 12, a second bladder pod 308 with three chambers 306 is provided in the forefoot region 16 on a medial side 22 of the sole structure 12, and a third bladder pod 310 with three chambers 306 is provided in the forefoot region 16 on a lateral side 24 of the sole structure 12. In this design, each chamber 306 may be fiber-reinforced on both an upper surface/upper most sheet 312 and on a lower surface/lowermost sheet 314.

As best illustrated in the schematic exploded view 320 provided in FIG. 16B, each of the three bladder pods 304, 308, 310 may be disposed between an upper plate 322 and a lower plate 324. These plates 322, 324 should have sufficient rigidity to induce a compression of the respective bladder chambers when a dynamic compression/impact load is applied via a wearer's foot. In this embodiment, each pod may maintain a static pressure of between about 30 psi and about 60 psi. In some embodiments, to concentrate the compressive load on each chamber 306 even more, each chamber 306 may be mounted between opposing posts 326. Each post 326 may have a diameter (or more generally a perimeter) that is smaller than a corresponding diameter (or perimeter) of the bladder chamber 306. In some embodiments, the diameter or perimeter of the post 326 may be less than about 70% of the diameter or perimeter of the chamber 306. In other embodiments, the diameter or perimeter of the post 326 may be less than about 50% of the diameter or perimeter of the chamber 306. While posts are not strictly required to utilize these designs, as the internal pressure of the bladder increases, a load-concentrating/pressure increasing feature may be desirable to increase the amount of compressive deformation during an impact.

In the design provided in FIGS. 16A and 16B, the sole structure 12 may further include one or both of an upper midsole cushioning component 330 between the upper plate 322 and the upper 26, and a lower midsole cushioning component 332 between the lower plate 324 and the outsole 30. These midsole cushioning components 330, 332 may be formed from a foamed, polymeric material that is selected to dampen impact forces while ideally returning energy to the wearer's foot upon rebounding from the impact. Referring again to FIG. 16A, in some embodiments, the lower and/or upper posts 326 may be at least partially hidden from sight by recessing the respective plate 322, 324 into the upper/lower midsole cushioning component 330, 332. In the embodiment shown, the lower plate 324 is recessed into the lower midsole cushioning component 332 to the point where the bonding flange 44 of the bladder is about flush with the top of the lower midsole cushioning component 332.

While the prior disclosure has generally focused on integrating a plurality of reinforcing fibers into the polymeric sheets that form the bladder, in some embodiments additional films or sheets with linear or non-linear stiffnesses may be locally or regionally provided in a similar manner to alter dimensional stiffnesses in the polymeric sheet.

To assist and clarify the description of various embodiments, various terms are defined herein. Unless otherwise indicated, the following definitions apply throughout this specification (including the claims). Additionally, all references referred to are incorporated herein in their entirety.

An "article of footwear", a "footwear article of manufacture", and "footwear" may be considered to be both a machine and a manufacture. Assembled, ready to wear footwear articles (e.g., shoes, sandals, boots, etc.), as well as discrete components of footwear articles (such as a midsole, an outsole, an upper component, etc.) prior to final assembly into ready to wear footwear articles, are considered and alternatively referred to herein in either the singular or plural as "article(s) of footwear".

"A", "an", "the", "at least one", and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range.

The terms "comprising", "including", and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

For consistency and convenience, directional adjectives may be employed throughout this detailed description corresponding to the illustrated embodiments. Those having ordinary skill in the art will recognize that terms such as "above", "below", "upward", "downward", "top", "bottom", etc., may be used descriptively relative to the figures, without representing limitations on the scope of the invention, as defined by the claims.

The term "longitudinal" refers to a direction extending along a length of a component. For example, a longitudinal direction of a shoe extends between a forefoot region and a heel region of the shoe. The term "forward" or "anterior" is used to refer to the general direction from a heel region toward a forefoot region, and the term "rearward" or "posterior" is used to refer to the opposite direction, i.e., the direction from the forefoot region toward the heel region. In some cases, a component may be identified with a longitudinal axis as well as a forward and rearward longitudinal direction along that axis. The longitudinal direction or axis may also be referred to as an anterior-posterior direction or axis.

The term "transverse" refers to a direction extending along a width of a component. For example, a transverse direction of a shoe extends between a lateral side and a medial side of the shoe. The transverse direction or axis may also be referred to as a lateral direction or axis or a mediolateral direction or axis.

The term "vertical" refers to a direction generally perpendicular to both the lateral and longitudinal directions. For example, in cases where a sole is planted flat on a ground surface, the vertical direction may extend from the ground surface upward. It will be understood that each of these directional adjectives may be applied to individual components of a sole. The term "upward" or "upwards" refers to the vertical direction pointing towards a top of the component, which may include an instep, a fastening region and/or a throat of an upper. The term "downward" or "downwards" refers to the vertical direction pointing opposite the upwards direction, toward the bottom of a component and may generally point towards the bottom of a sole structure of an article of footwear.

The "interior" of an article of footwear, such as a shoe, refers to portions at the space that is occupied by a wearer's foot when the shoe is worn. The "inner side" of a component refers to the side or surface of the component that is (or will be) oriented toward the interior of the component or article of footwear in an assembled article of footwear. The "outer side" or "exterior" of a component refers to the side or surface of the component that is (or will be) oriented away from the interior of the shoe in an assembled shoe. In some cases, other components may be between the inner side of a component and the interior in the assembled article of footwear. Similarly, other components may be between an outer side of a component and the space external to the assembled article of footwear. Further, the terms "inward" and "inwardly" refer to the direction toward the interior of the component or article of footwear, such as a shoe, and the terms "outward" and "outwardly" refer to the direction toward the exterior of the component or article of footwear, such as the shoe. In addition, the term "proximal" refers to a direction that is nearer a center of a footwear component, or is closer toward a foot when the foot is inserted in the article of footwear as it is worn by a user. Likewise, the term "distal" refers to a relative position that is further away from a center of the footwear component or is further from a foot when the foot is inserted in the article of footwear as it is worn by a user. Thus, the terms proximal and distal may be understood to provide generally opposing terms to describe relative spatial positions.

While various embodiments have been described, the description is intended to be exemplary, rather than limiting and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative and exemplary of the entire range of alternative embodiments that an ordinarily skilled artisan would recognize as implied by, structurally and/or functionally equivalent to, or otherwise rendered obvious based upon the included content, and not as limited solely to those explicitly depicted and/or described embodiments.

The following clauses present various embodiments of the present technology and are intended to be read in light of the preceding disclosure and figures.

Clause 1. A sole structure for an article of footwear comprising: a fluid-filled bladder comprising: a plurality of coextensive, stacked polymeric sheets including a first polymeric sheet and a second polymeric sheet; an anti-weld material disposed between the first polymeric sheet and the second polymeric sheet within a central region of the first polymeric sheet and the second polymeric sheet, the anti-weld material operative to inhibit the first polymeric sheet from being able to thermally fuse with the second polymeric sheet wherever the anti-weld material is present; wherein the first polymeric sheet and the second polymeric sheet are fused together in a peripheral region that surrounds the central region, the peripheral region forming a peripheral flange; and wherein at least one of the first polymeric sheet and second polymeric sheet includes a plurality of integrated reinforcing fibers that are operative to increase a modulus of elasticity of the sheet in a direction parallel to the reinforcing fibers.

Clause 2. The sole structure of clause 1, wherein the central region defines a fluid-filled chamber, and wherein the fluid-filled chamber comprises an internal fluid that is pressurized to a relative pressure of between 20 psi and 60 psi.

Clause 3. The sole structure of clause 2, wherein the plurality of reinforcing fibers extend across only a portion of the fluid-filled chamber.

Clause 4. The sole structure of clause 1, wherein the first polymeric sheet includes the plurality of integrated reinforcing fibers and wherein the second polymeric sheet does not include any integrated reinforcing fibers.

Clause 5. The sole structure of clause 1, wherein each of the first polymeric sheet and the second polymeric sheet comprise a thermoplastic polymer.

Clause 6. The sole structure of clause 5, wherein the plurality of reinforcing fibers each comprise a thermoplastic material.

Clause 7. The sole structure of clause 1, further comprising a non-foamed, polymeric upper plate provided on a first side of the bladder and a non-foamed polymeric lower plate provided on an opposite, second side of the bladder; wherein each of the upper plate and the lower plate are in contact with the bladder and operative to apply a compressive load to the bladder.

Clause 8. The sole structure of clause 7, wherein the upper plate comprises an upper plate portion and a first pressure increasing protrusion, wherein the first pressure increasing protrusion extends from the upper plate portion toward the lower plate and into contact with the central region of the first polymeric sheet; and wherein the lower plate comprises a lower plate portion and a second pressure increasing protrusion, wherein the second pressure increasing protrusion extends from the lower plate portion toward the upper plate and into contact with the central region of the second polymeric sheet; and wherein the first and second pressure increasing protrusions are operative to impinge into the bladder when a compressive load is applied between the upper plate and the lower plate.

Clause 9. The sole structure of clause 8, further comprising a polymeric foam cushioning element in contact with the upper plate on an opposite side of the plate from the bladder.

Clause 10. The sole structure of clause 1, wherein the first polymeric sheet is a composite comprising two polymeric layers and a layer of unidirectional reinforcing fibers disposed between two polymeric layers.

Clause 11. The sole structure of clause 1, wherein each fiber of the plurality of integrated reinforcing fibers is entirely embedded within a thickness of one of the at least one of the first polymeric sheet and second polymeric sheet.

Clause 12. The sole structure of clause 1, wherein the plurality of integrated reinforcing fibers do not span between the first polymeric sheet and the second polymeric sheet.

Clause 13. The sole structure of clause 1, wherein the plurality of integrated reinforcing fibers are provided on an opposite side of the at least one of the first polymeric sheet and second polymeric sheet from the anti-weld material.

Clause 14. An article of footwear comprising: an upper; and a sole structure coupled with the upper, the sole structure including a fluid filled bladder, the fluid filled bladder comprising at least a first polymeric sheet joined with a second polymeric sheet to define an internal volume therebetween, the internal volume being pressurized with a fluid at a pressure that is greater than a surrounding atmospheric pressure; and wherein at least one of the first polymeric sheet and second polymeric sheet includes a plurality reinforcing fibers that are operative to increase a modulus of elasticity of the sheet in a direction parallel to the reinforcing fibers.

Clause 15. The article of footwear of clause 14, wherein each of the first polymeric sheet and second polymeric sheet has a respective inner surface and a respective outer surface, wherein the inner surface is located between the outer surface and the internal volume; and wherein plurality reinforcing fibers are provided on the outer surface of at least one of the first polymeric sheet and the second polymeric sheet.

Clause 16. The article of footwear of clause 14, wherein at least one of the first polymeric sheet and second polymeric sheet includes an area that is devoid of reinforcing fibers.

Clause 17. The article of footwear of clause 14, wherein the internal volume is pressurized to a relative pressure of between 30 psi and 60 psi.

Clause 18. The article of footwear of clause 14, further comprising an anti-weld material disposed between a portion of the first polymeric sheet and a portion of the second polymeric sheet, the anti-weld material being operative to prevent the portion of the first polymeric sheet from bonding to the portion of the second polymeric sheet during the joining of the first polymeric sheet to the second polymeric sheet.

Clause 19. The article of footwear of clause 14, wherein only one of the first polymeric sheet and the second polymeric sheet includes the plurality reinforcing fibers.

Clause 20. The article of footwear of clause 14, wherein the sole structure further comprises a non-foamed, polymeric upper plate provided on a first side of the bladder and a polymeric lower plate provided on an opposite, second side of the bladder; wherein each of the upper plate and the lower plate are in contact with the bladder and operative to apply a compressive load to the bladder wherein the upper plate comprises an upper plate portion and a first pressure increasing protrusion, wherein the first pressure increasing protrusion extends from the upper plate portion toward the lower plate and into contact with the central region of the first polymeric sheet; and wherein the lower plate comprises a lower plate portion and a second pressure increasing protrusion, wherein the second pressure increasing protrusion extends from the lower plate portion toward the upper plate and into contact with the central region of the second polymeric sheet; and wherein the first and second pressure increasing protrusions are operative to impinge into the bladder when a compressive load is applied between the upper plate and the lower plate.

What is claimed is:

1. A sole structure for an article of footwear, the sole structure comprising:

a fluid-filled bladder comprising:

a plurality of coextensive, stacked polymeric sheets including a first polymeric sheet and a second polymeric sheet;

an anti-weld material disposed between the first polymeric sheet and the second polymeric sheet within a central region of the first polymeric sheet and the second polymeric sheet, the anti-weld material operative to inhibit the first polymeric sheet from being able to thermally fuse with the second polymeric sheet at locations where the anti-weld material is present between the first polymeric sheet and the second polymeric sheet;

wherein the first polymeric sheet and the second polymeric sheet are fused together in a peripheral region that surrounds the central region, the peripheral region forming a peripheral flange; and wherein at least one of the first polymeric sheet and the second polymeric sheet includes a plurality of reinforcing fibers that are integrally affixed to an outer surface of the at least one of the first polymeric sheet and the second polymeric sheet, the plurality of reinforcing fibers operative to increase a modulus of elasticity of the at least one of the first polymeric sheet and the second polymeric sheet in a direction parallel to the plurality of reinforcing fibers, and wherein the peripheral flange is devoid of the plurality of reinforcing fibers.

2. The sole structure of claim 1, wherein the central region defines a fluid-filled chamber, and wherein the fluid-filled chamber comprises an internal fluid that is pressurized to a relative pressure of between 20 psi and 60 psi.

3. The sole structure of claim 2, wherein the plurality of reinforcing fibers extend across only a portion of the fluid-filled chamber.

4. The sole structure of claim 1, wherein the first polymeric sheet includes the plurality of integrated reinforcing fibers and wherein the second polymeric sheet does not include any integrated reinforcing fibers.

5. The sole structure of claim 1, wherein each of the first polymeric sheet and the second polymeric sheet comprise a thermoplastic polymer.

6. The sole structure of claim 5, wherein the plurality of reinforcing fibers each comprise a thermoplastic material.

7. The sole structure of claim 1, further comprising a non-foamed, polymeric upper plate provided on a first side of the fluid-filled bladder and a non-foamed, polymeric lower plate provided on an opposite, second side of the fluid-filled bladder;

wherein each of the non-foamed, polymeric upper plate and the non-foamed, polymeric lower plate are in contact with the fluid-filled bladder and operative to apply a compressive load to the fluid-filled bladder.

8. The sole structure of claim 7, wherein the non-foamed, polymeric upper plate comprises an upper plate portion and a first pressure increasing protrusion, wherein the first pressure increasing protrusion extends from the upper plate portion toward the non-foamed, polymeric lower plate and into contact with the central region of the first polymeric sheet; and wherein the non-foamed, polymeric lower plate comprises a lower plate portion and a second pressure increasing protrusion, wherein the second pressure increasing protrusion extends from the lower plate portion toward the non-foamed, polymeric upper plate and into contact with the central region of the second polymeric sheet; and wherein the first and second pressure increasing protrusions are operative to impinge into the fluid-filled bladder when a compressive load is applied between the non-foamed, polymeric upper plate and the non-foamed, polymeric lower plate.

9. The sole structure of claim 8, further comprising a polymeric foam cushioning element in contact with the non-foamed, polymeric upper plate on an opposite side of the non-foamed, polymeric upper plate from the fluid-filled bladder.

10. The sole structure of claim 1, wherein the plurality of integrated reinforcing fibers do not span between the first polymeric sheet and the second polymeric sheet.

11. The sole structure of claim 1, wherein the plurality of reinforcing fibers are provided on an opposite side of the at least one of the first polymeric sheet and the second polymeric sheet from the anti-weld material.

12. An article of footwear comprising:

an upper; and a sole structure coupled with the upper, the sole structure including a fluid filled bladder, the fluid filled bladder comprising at least a first polymeric sheet joined with a second polymeric sheet to define an internal volume between the first polymeric sheet and the second polymeric sheet, the internal volume being capable of being pressurized with a fluid at a pressure that is greater than a surrounding atmospheric pressure; and wherein at least one of the first polymeric sheet and the second polymeric sheet includes a plurality reinforcing fibers that are integrally affixed to an outer surface of the at least one of the first polymeric sheet and the second polymeric sheet, the plurality of reinforcing fibers operative to increase a modulus of elasticity of the at least one of the first polymeric sheet and the second polymeric sheet in a direction parallel to the plurality of reinforcing fibers, and wherein a peripheral region where the first polymeric sheet is joined with the second polymeric sheet is devoid of the plurality of reinforcing fibers.

13. The article of footwear of claim 12, wherein each of the first polymeric sheet and second polymeric sheet has a respective inner surface and a respective outer surface, wherein each respective inner surface is located between each respective outer surface and the internal volume; and wherein the plurality reinforcing fibers are provided on the respective outer surface of at least one of the first polymeric sheet and the second polymeric sheet.

14. The article of footwear of claim 12, wherein at least one of the first polymeric sheet and the second polymeric sheet includes an area that is devoid of reinforcing fibers.

15. The article of footwear of claim 12, wherein the internal volume is pressurized to a relative pressure of between 30 psi and 60 psi.

16. The article of footwear of claim 12, further comprising an anti-weld material disposed between a portion of the first polymeric sheet and a portion of the second polymeric sheet, the anti-weld material being operative to prevent the portion of the first polymeric sheet from bonding to the portion of the second polymeric sheet during the joining of the first polymeric sheet to the second polymeric sheet.

17. The article of footwear of claim 12, wherein only one of the first polymeric sheet and the second polymeric sheet includes the plurality reinforcing fibers.

18. The article of footwear of claim 12, wherein the sole structure further comprises a non-foamed, polymeric upper plate provided on a first side of the fluid-filled bladder and a non-foamed, polymeric lower plate provided on an opposite, second side of the fluid-filled bladder;

wherein each of the non-foamed, polymeric upper plate and the non-foamed, polymeric lower plate are in contact with the fluid-filled bladder and operative to apply a compressive load to the fluid-filled bladder wherein the non-foamed, polymeric upper plate comprises an upper plate portion and a first pressure increasing protrusion, wherein the first pressure increasing protrusion extends from the upper plate portion toward the non-foamed, polymeric lower plate and into contact with the central region of the first polymeric sheet; and wherein the non-foamed, polymeric lower plate comprises a lower plate portion and a second pressure increasing protrusion, wherein the second pressure increasing protrusion extends from the lower plate portion toward the non-foamed, polymeric upper plate and into contact with the central region of the second polymeric sheet; and wherein the first and second pressure increasing protrusions are operative to impinge into the fluid-filled bladder when a compressive load is applied between the non-foamed, polymeric upper plate and the non-foamed, polymeric lower plate.

* * * * *